US007072476B2

(12) United States Patent
White et al.

(10) Patent No.: US 7,072,476 B2
(45) Date of Patent: Jul. 4, 2006

(54) AUDIO HEADSET

(75) Inventors: Donald R. White, Beaverton, OR (US); Masahisa Masuda, Westlinn, OR (US)

(73) Assignee: Matech, Inc., Portland, OR (US)

( * ) Notice: Subject to any disclaimer, the term of this patent is extended or adjusted under 35 U.S.C. 154(b) by 284 days.

(21) Appl. No.: 10/342,102

(22) Filed: Jan. 13, 2003

(65) Prior Publication Data

US 2004/0136543 A1 Jul. 15, 2004

Related U.S. Application Data

(63) Continuation of application No. PCT/US01/22121, filed on Jul. 13, 2001, which is a continuation-in-part of application No. 09/878,151, filed on Jun. 7, 2001, now abandoned, and a continuation-in-part of application No. 09/615,168, filed on Jul. 13, 2000, now abandoned, which is a continuation-in-part of application No. 08/989,816, filed on Dec. 12, 1997, now Pat. No. 6,370,245, which is a continuation-in-part of application No. 08/801,525, filed on Feb. 18, 1997, now Pat. No. 5,907,538.

(60) Provisional application No. 60/265,988, filed on Feb. 2, 2001, provisional application No. 60/230,217, filed on Sep. 5, 2000, provisional application No. 60/228,129, filed on Aug. 25, 2000, provisional application No. 60/223,291, filed on Aug. 3, 2000.

(51) Int. Cl.
*H04R 1/10* (2006.01)

(52) U.S. Cl. ..... 381/74; 381/328; 381/71.1; 370/276

(58) Field of Classification Search ..... 381/74; 379/406.08; 370/276
See application file for complete search history.

(56) References Cited

U.S. PATENT DOCUMENTS

| | | | |
|---|---|---|---|
| 3,114,105 | A | 12/1963 | Neumiller |
| 3,370,236 | A | 2/1968 | Walker |
| 3,781,492 | A | 12/1973 | Cragg, et al. |
| 3,829,624 | A | 8/1974 | Goodin et al. |
| 4,002,860 | A | 1/1977 | Terai et al. |
| 4,052,562 | A | 10/1977 | Andersen |
| 4,065,646 | A | 12/1977 | Schuh |

(Continued)

FOREIGN PATENT DOCUMENTS

JP 0032833 4/1981

(Continued)

OTHER PUBLICATIONS

Sedra et al., "Microelectronic Circuits", Jul. 1990, second edition, p. 143.

(Continued)

*Primary Examiner*—Huyen Le
*Assistant Examiner*—Con P. Tran
(74) *Attorney, Agent, or Firm*—Marger Johnson & McCollom, P.C.

(57) ABSTRACT

A headset includes two earpieces. One earpiece acts as a microphone, and the other earpiece acts as an earphone. Isolated from background noise and vibrations due to bone conduction, the microphone earpieces convert voice sounds from the air column in the external ear canal into electrical signals. Other embodiments of the invention address feedback problems and achieve improved performance relative to existing full duplex communication devices. In another embodiment of the invention a headset includes a band having opposite ends that extend in a forward direction from the two earpieces. The band then either extends downwardly or backwards.

17 Claims, 23 Drawing Sheets

U.S. PATENT DOCUMENTS

| | | | | |
|---|---|---|---|---|
| 4,156,800 | A | | 5/1979 | Sear et al. |
| 4,280,018 | A | | 7/1981 | Lazarus et al. |
| 4,403,120 | A | | 9/1983 | Yoshimi |
| 4,598,396 | A | | 7/1986 | Upp et al. |
| 4,629,829 | A | | 12/1986 | Puhl et al. |
| 4,644,330 | A | | 2/1987 | Dowling |
| 4,668,842 | A | | 5/1987 | Yokoyama et al. |
| 4,691,313 | A | | 9/1987 | Iwata |
| 4,696,045 | A | | 9/1987 | Rosenthal |
| 4,741,018 | A | | 4/1988 | Potratz et al. |
| 4,833,719 | A | | 5/1989 | Carme et al. |
| 4,837,829 | A | | 6/1989 | Lobb |
| 4,912,758 | A | | 3/1990 | Arbel |
| 5,007,046 | A | | 4/1991 | Erving et al. |
| 5,099,519 | A | | 3/1992 | Guan |
| 5,115,471 | A | | 5/1992 | Liden |
| 5,118,309 | A | | 6/1992 | Ford |
| 5,168,522 | A | | 12/1992 | Simanis et al. |
| 5,172,410 | A | | 12/1992 | Chace |
| 5,235,637 | A | | 8/1993 | Kraz et al. |
| 5,265,264 | A | | 11/1993 | Dzung et al. |
| 5,287,406 | A | | 2/1994 | Kakuishi |
| 5,311,144 | A | | 5/1994 | Grasset |
| 5,335,286 | A | | 8/1994 | Carlson |
| 5,379,450 | A | | 1/1995 | Hirasawa et al. |
| 5,393,989 | A | | 2/1995 | Gempe et al. |
| 5,410,595 | A | * | 4/1995 | Park et al. ..... 379/406.08 |
| 5,465,298 | A | | 11/1995 | Wilkison et al. |
| 5,471,666 | A | | 11/1995 | Sugiyama et al. |
| 5,586,193 | A | | 12/1996 | Ichise et al. |
| 5,692,059 | A | | 11/1997 | Kruger |
| 5,715,309 | A | | 2/1998 | Bartowiak |
| 5,824,966 | A | | 10/1998 | Leight |
| 5,899,973 | A | | 5/1999 | Bandara |
| 5,907,538 | A | * | 5/1999 | White ..... 370/276 |
| 6,104,824 | A | | 8/2000 | Ito |
| 6,175,633 | B1 | | 1/2001 | Morrill et al. |

FOREIGN PATENT DOCUMENTS

| | | |
|---|---|---|
| WO | WO97/27721 | 7/1997 |
| WO | WO98/45937 | 10/1998 |

OTHER PUBLICATIONS

Frank Kasparec, St. Poelten, Austria, Bilateral Speaker Networks Form Switchless Intercom, Electronics, vol. 53, p. 131, Jul. 3, 1980.

Compandor IC (Noise Reduction System), TK10651M, -L, -D, TokyoSemiconductor, Catalog No. Z-1480110E.

D5004 Cellular Telephone Echo Control Device, DSP Group, Inc., Jan. 1991, Rev. 2.0.

Telephone Coupling Transformer, Mouser Electronics, Feb. 16, 1995.

Audio Transformers Telephone Coupling, Magna Tek, 90 East Union Street, Goodland, IN 47948.

Engineering Bulletin, Magnetek Goodland, pp. 2-3.

Low Voltage Compander, Specification and Applications Information, Motorola Semiconductors, MC33110.

LA8632M Case Outline: MFP-24S(300mil) Plastic Package.

* cited by examiner

CELLULAR PHONE

AUDIO PLAYER WITH CELLULAR PHONE

CELLULAR PHONE

PLAYER WITH CELLULAR PHONE

AUDIO HEADSET

This application:

a) claims priority from U.S. Provisional Application Ser. No. 60/265,988, filed Feb. 2, 2001; U.S. Provisional Application Ser. No. 60/230,217, filed Sep. 5, 2000; U.S. Provisional Application Ser. No. 60/228,129, filed Aug. 25,2000; U.S. Provisional Application Ser. No. 60/223,291, filed Aug. 3, 2000, all of which are herein incorporated by reference in their entirety; and b) is a continuation of International Application No. PCT/US01/22121, filed Jul. 13, 2001, which is:

(1) a continuation-in-part of U.S. application Ser. No. 09/878,151, filed Jun. 7, 2001, now abandoned; and (2) a continuation-in-part of U.S. application Ser. No. 09/615,168, filed Jul. 13, 2000, now abandoned, which is a continuation-in-part of U.S. application Ser. No. 08/989,816, filed Dec. 12, 1997, now U.S. Pat. No. 6,370,245, which is a continuation-in-part of U.S. application Ser. No. 08/801,525, filed Feb. 18, 1997, now U.S. Pat. No. 5,907,538, all of which are herein incorporated by reference in their entirety.

TECHNICAL FIELD

The invention relates to a headset for simultaneously talking and listening in a full duplex mode of communication by utilizing a separate function transducer in each ear. Such devices are particularly useful in higher noise environments, such as noisy offices, inside moving automobiles and trucks, factories, heavy traffic, inside commuter trains, buses and loud music.

BACKGROUND

It is difficult to use a telephone handset in noisy environments, and particularly handsets for hand-held wireless phones. To reduce the impact of background noise, many people hold hand-held cell phones at one ear and use their index finger or the palm of their other hand to plug or cover the opposite ear. This scenario vividly portrays a necessary, yet uncomfortable method of talking and listening with portable telephones in noisy environments. With the rapid growth of portable telephones and the widespread use of these phones in noisy environments, there is a demand for new headset configurations that can significantly reduce the inconvenience of noisy interference.

A Voice Recognition System (VRS) detects and decodes human voice signals. The VRS is used in conjunction with word processing systems allowing an operator to enter words and commands orally without using a keyboard. The VRS converts the voice signals into digital words that are then either entered into a document in the word processing system or used to control word processing operations. In another application, the VRS is used in conjunction with a telephone menu system. Instead of having to press telephone keys, the user orally enters the information, command, or selection from the telephone menu.

The accuracy of the VRS in converting voice signals into the correct words and sentences varies depending on the quality of the voice signals received from the human operator. For example, most VRS systems include a microphone on a boom that is positioned over the operators mouth. The microphone picks up the operator's voice but also picks up unwanted ambient noises. These unwanted noises may include general office noise in the same room as the operator and nonverbal sounds made from the operator, such as breathing noises. These unwanted noises often cause the VRS to misinterpret the voice signals coming from the operator.

Some headsets are used for two-way communication and include a microphone boom that extends over the mouth of the user. The microphone is located on the boom in order to pick up the voice signals generated from the mouth of the user. Because the microphone also picks up ambient noise, it is difficult to use these telephone headsets in noisy environments. Two-way headsets also use metal or plastic bands to support the boom and speaker earpiece. These headsets can easily be dislodged when the user is moving and also mess up the hair or disrupt headwear on the operator. The headset is also difficult to attach and detach if the headset operator is wearing a hat. Instead of using a plastic or metal band, some headsets use wires that hang loosely down from the earpieces. However, the earpieces in these headsets can easily dislodge from the user's ears.

The present invention addresses this and other problems associated with the prior art.

SUMMARY

One embodiment of the invention provides a headset with two earpieces: one acting as a microphone, and the other acting as an earphone. Isolated from background noise and vibrations due to bone conduction, the microphone earpiece converts voice sounds from the air column in the external ear canal into electrical signals. The earphone converts electrical signals from an audio device into an audio output in the other earpiece. This headset configuration provides full duplex communication while isolating background noise.

A miniature piezoelectric, electret type, transducer is installed into one earpiece housing. This transducer is electrically dedicated to respond to a user's outgoing audio sounds. The audio sounds within the air column of the external auditory canal in one ear acoustically drive the miniature transducer producing electrical transmit (Tx) signals without the outside noisy sounds. In order to reduce and isolate bone conduction voice sounds, which result in a concentration of low frequency voice energy, a sound conduction isolation "cup" serves as a jacket that surrounds the miniature transducer inside the housing. The sound conduction cup suspends the transducer in the ear canal in a manner that improves the quality of the Tx signal generated by the transducer.

In one embodiment, a second miniature transducer is incorporated into a second identical ear-piece housing. This second transducer receives the incoming Rx electrical signal and produces acoustical sounds within the external auditory canal in the other ear of the user. The ear phone wires are joined together into one three conductor cord terminated to a standard 3.5 mm plug or 2.5 mm plug for direct plug-in. No additional electronic circuits or modifications are required. A cell phone, cordless telephone or regular corded telephone includes an external corresponding plug-in jack for receiving the headset plug.

Another embodiment of the invention addresses feedback problems and achieves improved performance relative to existing full duplex communication devices. Operating simultaneously as both an earphone and a microphone, the transducer output comprises a combined transmit and receive signal. In order to operate this circuit design with minimal feedback, a specific circuit takes this combined signal and decreases the receive signal relative to the transmit signal. The circuit also decreases the Tx feed-through from the telephone hybrid relative to the receive signal.

The full duplex headset is used in various audio applications. In one application, one headphone is used as a speaker while a second headphone is used as either a speaker or a microphone. The headphones provide stereo sound when attached to a device such as a radio, CD, MD, or MP3 player. One of the headphones switches to operating as a microphone when the device is operating as a two-way communication device, such as a cellular telephone. A user then conducts hands free two-way communications using the same headset. When the device switches back to operation as an audio player, the microphone headphone returns to operating as a speaker. The headset then returns to providing stereophonic sound. In another application, the full duplex headset is used in conjunction with a Voice Recognition System (VRS) to more accurately convert human speech into digital text.

In yet another embodiment of the invention, a headset includes earpieces for attaching to ears of an operator. A band has opposite ends that connect to the two earpieces and extends in a forward direction from the two earpieces. The band then either extends downwardly below the chin or extends backwards in back of the neck.

The foregoing and other objects, features and advantages of the invention will become more readily apparent from the following detailed description of a preferred embodiment of the invention which proceeds with reference to the accompanying drawings.

DETAILED DESCRIPTION

Figure 1:
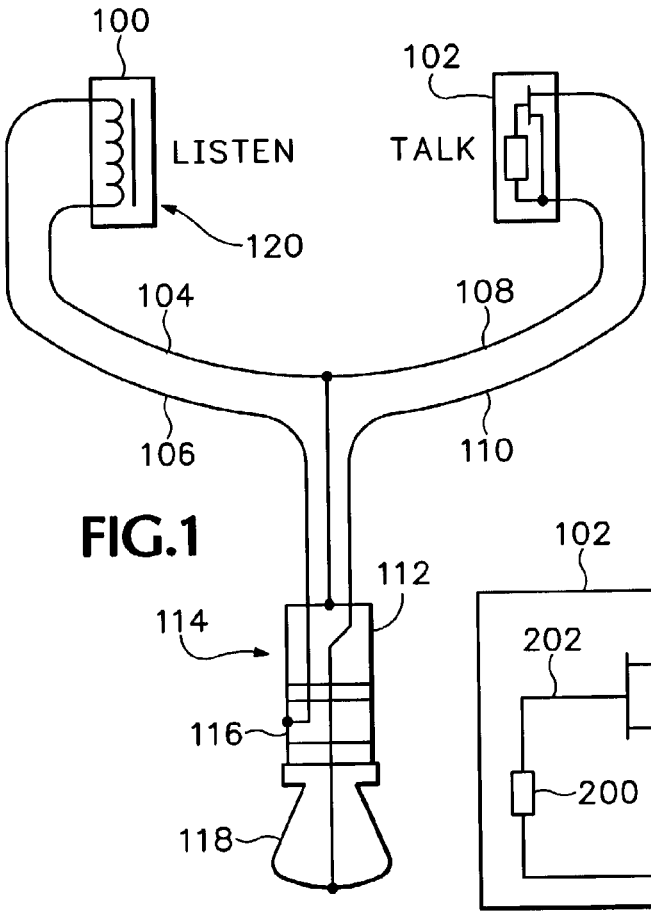
FIG. 1 is a schematic diagram of a full duplex headset, showing the electrical connection of earphone and microphone earpieces to a standard plug.

FIG. 1 is a schematic diagram of a full duplex headset. The headset has two earpieces: an earphone earpiece 100 and a microphone earpiece 102. Each earpiece has two electrical terminals, with one serving as the common or "ground" node. A pair of wires 104, 106 and 108, 110 are connected to these terminals, and are ultimately joined in a single cord terminating in a connector plug 114. The wires connected to the ground node 104, 108 are joined together and terminate at the sleeve 112 of plug 114. The wire connected to the opposite terminal of the earphone relative to the common terminal is connected to the ring portion 116 of the plug 114. On the other side of the headset, the wire 110 in the microphone 102 is connected to the tip portion 118 of the plug 114.

The earphone 100 contains a transducer 120 that converts an electrical signal into an audio output. The microphone earpiece 102 contains a transducer that converts an audio input into an electrical signal, which is communicated to a telephony device via the wires 108, 110.

By placing the microphone in the operator's ear, the transducer in the microphone can detect voice signals that pass from the users vocal cords through the operators head and out the external ear canal. Since the microphone is located inside the ear canal, ambient noise is filtered from the transducer.

Figure 2:
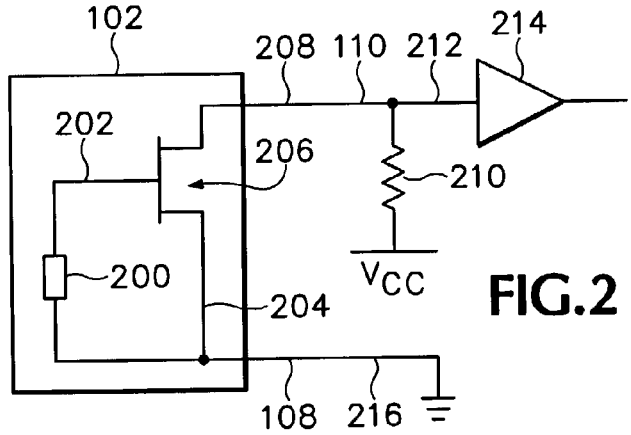
FIG. 2 is a schematic diagram illustrating circuitry of the microphone earpiece shown in FIG. 1 in more detail.

FIG. 2 is a schematic diagram illustrating circuitry within the microphone earpiece in more detail. The circuitry within the earpiece in this particular implementation includes a piezoelectric transducer 200 coupled across the gate node 202 and drain node 208 of a field effect transistor 206. The drain node 208 of the field effect transistor 206 is connected to the wire 110 that extends from the earpiece 102. The source node of the field effect transistor is connected to the wire for common ground node (108).

When the wearer of the headset speaks, the resulting voice sounds in the air column within the external auditory canal drive the piezoelectric transducer 200. The field effect transistor 206 transfers the electrical signal induced by the voice sounds through the wire 110 and into interface circuitry within the telephony device. This interface circuitry is conventional, and may include a resistor 210 coupled between the input port 212 that receives signals from the wire 110, on one side, and the VCC power supply on the other side. The telephony device may also have an amplifier 214 and other conventional interface circuitry to process the incoming electrical signal. The common ground wire 108 is connected to one terminal of the piezoelectric transducer 200. The drain of the field effect transistor 206 is coupled to ground via another port 216 of the telephony device.

Figure 3:
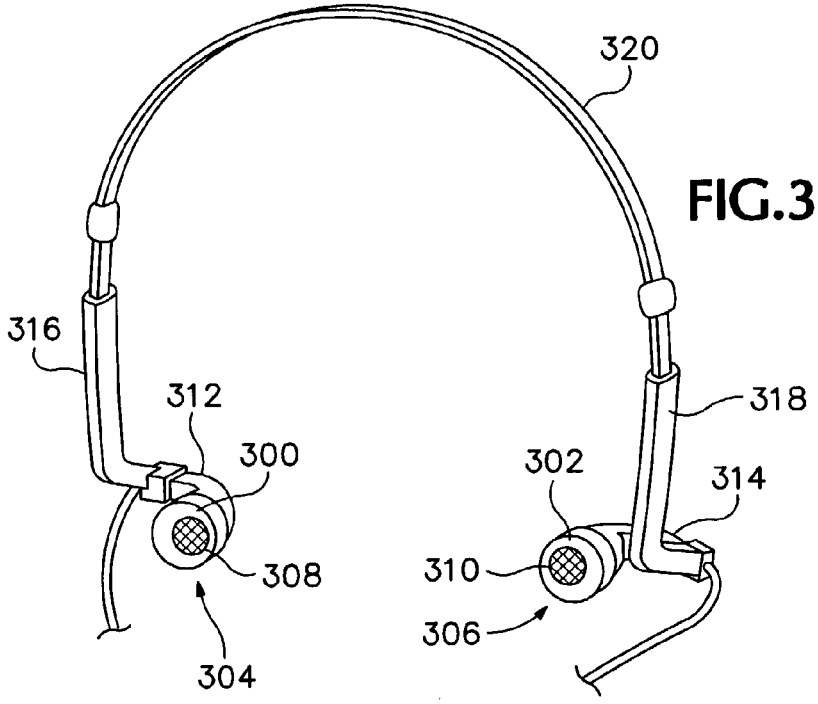
FIG. 3 illustrates an example of a headset configuration in which the earphone and microphone earpieces shown in FIG. 1 may be incorporated.

The headset configuration shown in FIG. 1 can be incorporated into a variety of headsets. FIG. 3 illustrates one possible example of a headset configuration in which the circuitry shown in FIGS. 1 and 2 may be incorporated. The headset shown in FIG. 3 is similar to the headsets typically used with portable radios, tape players, and CD players. Each of the earpieces 304, 306 have a similar structure. In particular, each earpiece includes a circular disk portion 300, 302 with a flat face. When resting inside the ear, the face of the earpiece is designed to be oriented in the direction of the external ear canal. A grill 308, 310 on the face of the earpiece allows voice sounds to be communicated to the microphone and from the earphone transducers.

A neck portion 312, 314 of the earpiece housing extends from the disk portion 300, 302 and is connected to the headset frame piece 316, 318. A metallic headband 320 fits within a sleeve of the frame pieces 316, 318 and allows the user to adjust the size of the headset.

Figure 4:
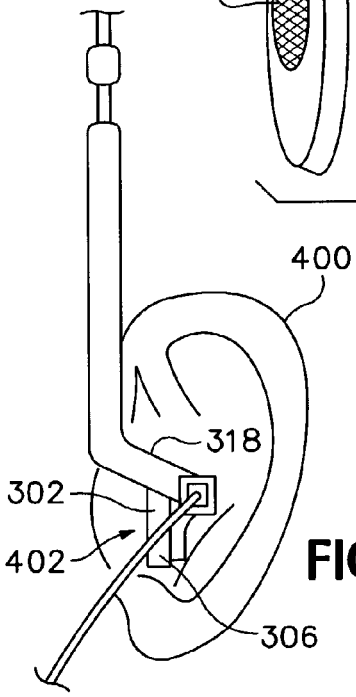
FIG. 4 illustrates how an earpiece of the headset shown in FIG. 3 rests within an ear of a user.

FIG. 4 shows an expanded view of the earpiece 306 from the headset shown in FIG. 3, resting within a user's ear 400. This particular illustration shows how the left earpiece 306 rests within a pocket of the ear such that the face 302 of the earpiece is oriented in the direction of the external ear canal 402. The neck portion 318 of the earpiece extends out of the ear and acts as a conduit for the cord carrying the two wires from the transducer inside the earpiece.

Figure 5:
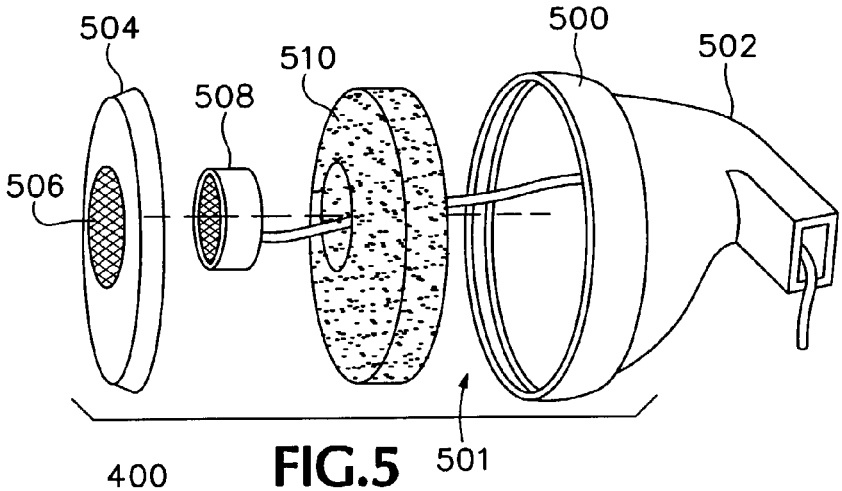
FIG. 5 is an exploded view of a microphone earpiece for the headset shown in FIGS. 3 and 4.

FIG. 5 is an exploded view of a microphone earpiece designed for the headset shown in FIGS. 3 and 4. As shown in FIG. 5, the earpiece housing includes a plastic disk-shaped housing 500 formed into a unitary piece along with the neck portion 502 of the housing 500. A cover 504 fits into an opening 501 in the housing 500 and has a grill portion 506 that allows audio sounds from the external auditory canal to pass into the housing 500 and drive a miniature microphone 508.

The microphone 508 is implemented with a piezoelectric transducer, and in particular, an electret-type transducer. The microphone sits within a cup 510 that acts as an acoustical isolator. The cup 510 fits tightly around the sides and rear of the electret and fills in the space between the electret and the inner walls of the earpiece housing 500.

The cup 510 acts as an acoustical isolator to prevent sounds attributable to bone conduction from reaching the microphone 508. Preferably, the acoustical isolator is made of a material that has a high air content isolate vibrations attributable to bone conduction. A variety of materials may serve this function, including, but not limited to, Styrofoam, plastic, wood, perlite, etc.

Figure 6:
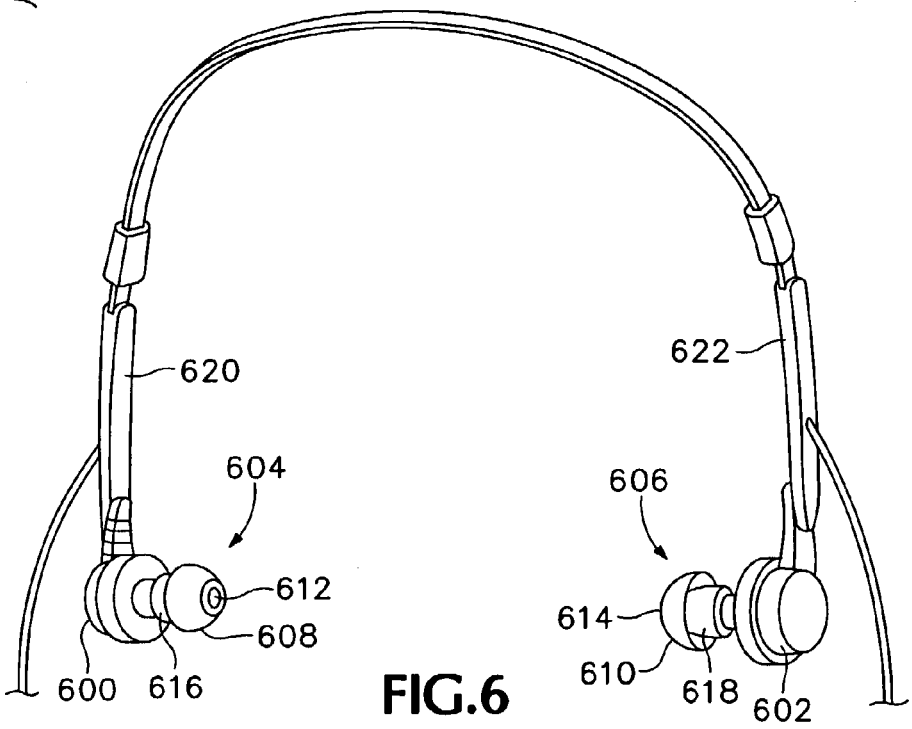
FIG. 6 is an alternative example of a headset in which the earphone and microphone earpieces shown in FIG. 1 may be incorporated.

FIG. 6 illustrates another example of a headset configuration that can incorporate the circuitry shown in FIG. 1. This particular configuration is especially effective in high noise environments because each of the earpieces 600, 602 has a nipple 604, 606 that penetrates into and fits snuggly within the wearer's external ear canal 402 (FIG. 4). The nipple 604, 606 comprises an umbrella-like shroud 608, 610 made of a soft, flexible material that conforms to the shape of the external auditory canal. The pinnacle of the shroud 608, 610 has an opening 612, 614 that allows air to pass to the transducer within the housing. The stalk 616, 618 of nipples 604, 606 is made of a harder plastic and is roughly cone-shaped, with a circumference that decreases toward the openings 612, 614 of the nipples.

Figure 7:
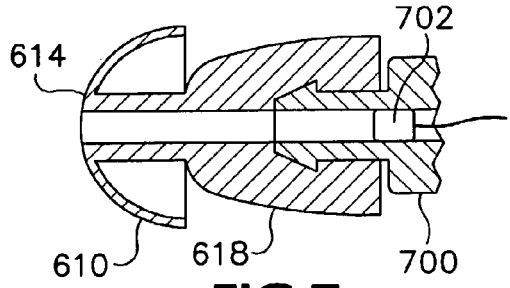
FIG. 7 shows a cross-sectional view of an earpiece of the headset shown in FIG. 6.

FIG. 7 shows a cross-sectional view of the nipple earpiece shown in FIG. 6. The stalk 618 of the nipple snaps onto an earpiece housing 700 that houses a piezoelectric microphone 702.

To reduce ear fatigue, the wires stemming from each earpiece extend through the housing and into the frame body 620, 622 of the headset (FIG. 6). This upward orientation of the wiring through the frame of the headset reduces the stress that would otherwise be directed to the earpiece if it extended from the bottom of the earpiece. While this particular configuration may tend to reduce fatigue on the ear, it is also possible to configure the earpieces so that the wiring extends from the side or bottom of the earpiece housing.

It is important to note that the headset configurations shown in FIGS. 4–7 represent only some examples of the many possible configurations in which the full duplex circuit configuration shown in FIG. 1 may be incorporated. While these configurations include a headset frame that fits over the wearer's head, it is also possible to implement the full duplex headset in a pair of earpieces that are held to the user's head in some other fashion. One possible alternative is to have ear clips mounted on each of the earpiece housings that clip around the wearer's ears. Another alternative is to use earpieces such as the ones shown in FIG. 6 that fit snuggly within the auditory canal without the need for external support from a headset frame.

The headsets described above provide hands-free full duplex communications without having to use an annoying microphone extension arm. A microphone does not have to be positioned near the mouth since the voice sounds are essentially provided through the ear canal.

Multiple transducer housing styles can be used to suit the various preferred choices of use. An earpiece attachment that protrudes outside the ear canal can be used for less noisy environments. The lightweight ear microphones use small miniature electro-dynamics transducers weighing approximately 5 grams or 0.18 oz. to minimize fatigue. The lightweight piezoelectric transducers further improve performance and reduce weight. Lightweight head bands, ear supports, and contoured transducer housings, such as those designed for security personnel, and the hearing impaired, provide snug fit in the outer car canal.

Figure 8:
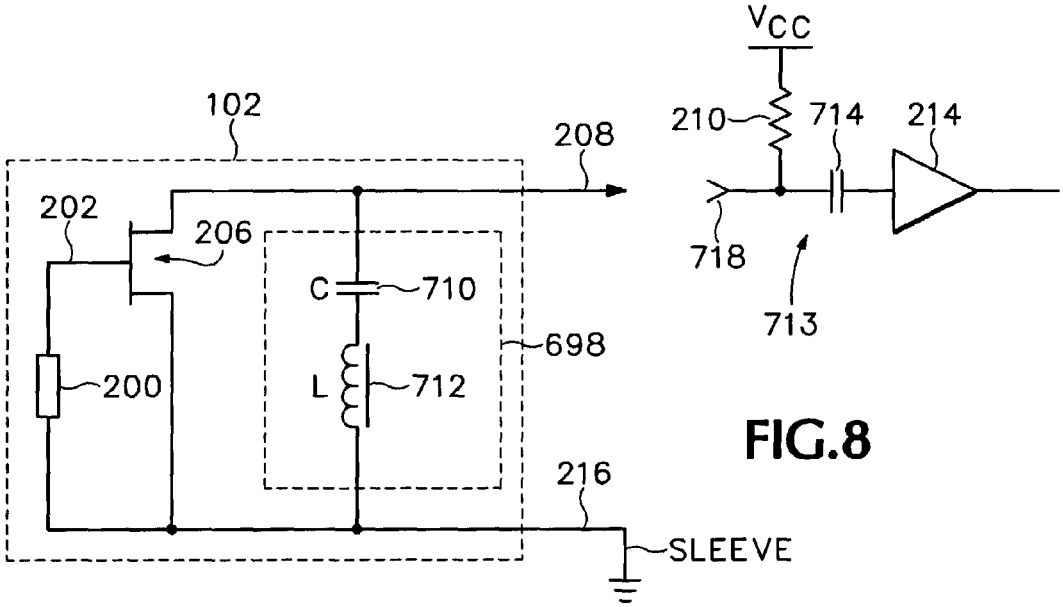
FIG. 8 shows an alternative implementation of the microphone earpiece circuitry shown in FIG. 2.

FIG. 8 shows a variation on the microphone earpiece circuit shown in FIG. 2. A filter circuit 698 includes a capacitor 710 and an inductor 712. The filter circuit 698 is coupled between the source and drain terminals of FET transistor 206. The capacitor 710 provides DC blocking between node 208 and node 216. The inductor 712 provides a low impedance at low audio frequencies and a high impedance at high audio frequencies. In one example, the inductor 712 is selected so that there is approximately ten times the impedance across FET transistor 206 at 3000 Hertz than at 300 Hertz.

The filter circuit 698 attenuates the low frequencies associated with bone conduction and low audio frequencies. Thus, the circuit 698 filters out some of the unwanted bone conduction and low frequency voice components that may be picked up by the transducer 200 while residing in the ear canal. Since consonants are generally pronounced using higher frequency components, the circuit 698 also provides better sound detection for consonants. In one embodiment, the inductor is made from a circular core material and wire is wrapped around this circular core material.

A transmit circuit 713 is used in cellular phones, cordless telephones or phone handsets. The transmit circuit 713 includes a resistor 210 and a capacitor 714. A connection 718 is coupled to the tip 118 of the plug 114 (FIG. 1). The voltage of the transmit signal at connection 718 is increased before being amplified by amplifier 214.

Full Duplex Earphone—Using One Transducer

Figures 9, 10:
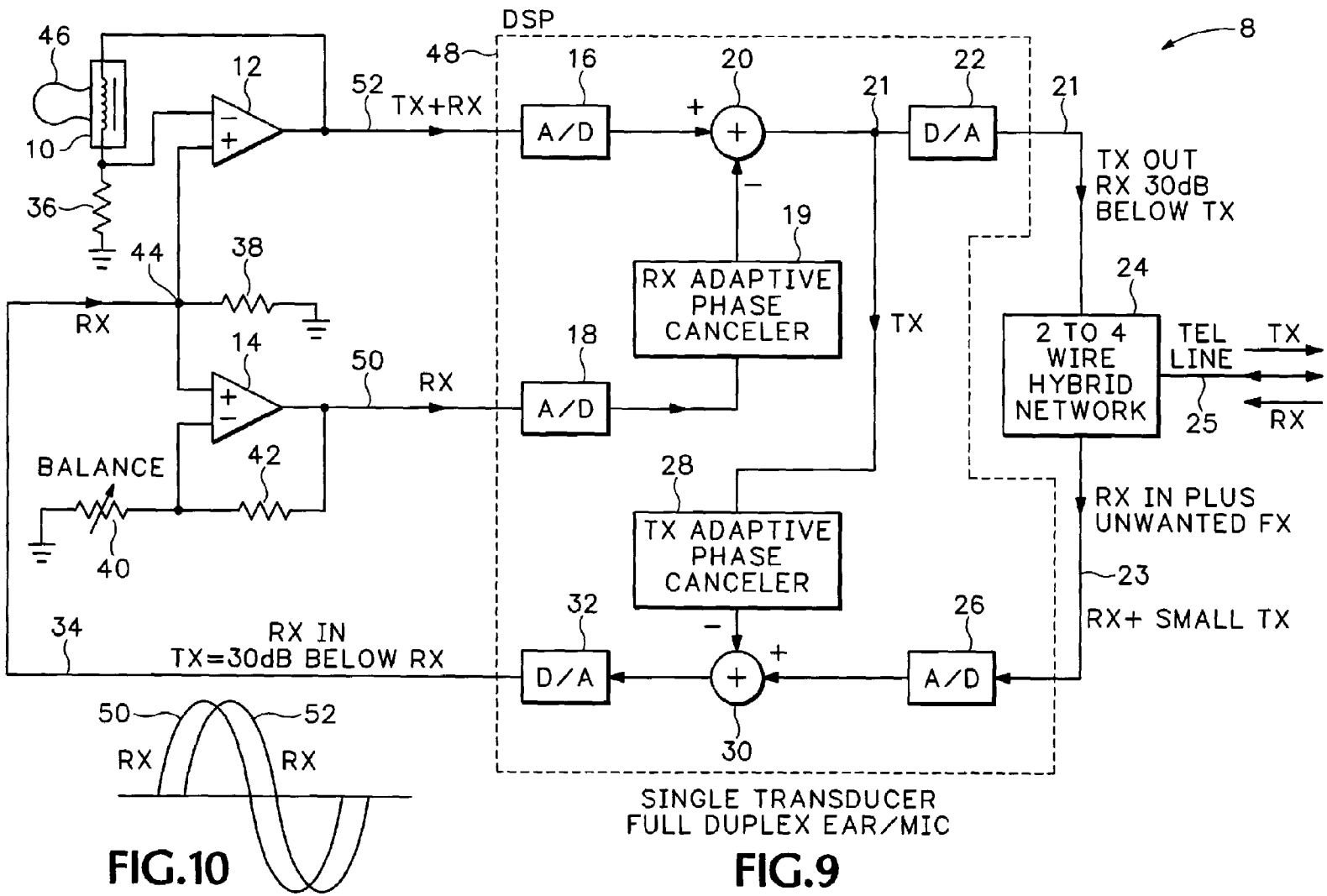
FIG. 9 is a diagram of a full duplex digital signal processing communication circuit according to an alternative embodiment of the invention.
FIG. 10 shows the phase shift of receive audio signals output from different amplifier stages in the communication circuit shown in FIG. 9.

FIG. 9 shows a circuit 8 that uses a single transducer 10 for full duplex analog earphone and microphone operation. A combination earphone and microphone transducer 10 is coupled between an inverting input and an output of an operational amplifier (op amp) 12. An earpiece 46 contains the transducer 10 and is adapted for inserting into the ear canal of a human operator. A noninverting input of op amp 12 is coupled to the noninverting input of an op amp 14. An inverting input of op amp 14 is coupled to a balancing resistor 40 and through a resistor 42 to an output of op amp 14. The balance resistor 40 is used to control the gain of the Rx signal output from op amp 14.

The output of op amp 12 is coupled through an analog to digital (A/D) converter 16 to a signal adder 20. The output of op amp 14 is coupled through an A/D converter 18 and a receive adaptive phase canceller 19 to the signal adder 20. An output 21 of signal adder 20 is fed through a digital to analog (D/A) converter 22 into the Tx input of a hybrid network 24. The Rx output of the signal adder is also fed through a transmit adaptive phase canceller 28 into signal adder 30. The output of the hybrid network circuit 24 is fed through an A/D converter 26 into the signal adder 30. An output of signal adder 30 is fed through a D/A 32 into the noninverting inputs of op amps 12 and 14 at node 44. Node 44 is also coupled by resistor 38 to ground.

In one embodiment, the components within the dashed line 48 describe functions that are implemented in software by a Digital Signal Processor (DSP). Some or all of the components within the dashed line can alternatively be implemented by discrete digital components. For example, the A/D and D/A converters may be implemented as discrete components while the signal adders and adaptive phase cancellers may also be implemented as discrete components or in software in a DSP.

The transducer 10 is used as both a microphone for detecting and generating audio signals from the operators voice and as an ear phone that generates audio signals heard by the operator from Rx audio signals received over the telephone line 25.

The audio signals from the talking operator are converted by the transducer 10 into Transmit (Tx) signals. The transducer 10, when operating as an earphone, converts receive signals (Rx) from the telephone line 25 into audible signals. These audible signals are heard in the external ear canal of the operator through the earpiece 46.

The hybrid network 24 represents circuitry used to compensate for the reactive characteristics of the telephone network connected to telephone line 25. The hybrid network 24 is a 2 to 4 wire hybrid circuit. The telephone line 25 is a two wire line that connects to 4 wires of the communication circuit 8. In the case of a wireless communication network, such as a cellular telephone, the hybrid network 24 may represent the voice encoder and transceiver circuitry in the cell phone or in the cell phone base station. Network 24 represents any circuitry in a landline based telephone network, or cellular telephone network that may leak part of the transmit signal back to the receive path of the communication circuit.

A receive audio signal Rx from telephone line 25 goes through the hybrid network 24, A/D 26 and D/A 32 into the noninverting inputs of op amps 12 and 14. A current mirror characteristic of the op amps 12 and 14 cause the same Rx signal to be output at the inverting inputs of op amps 12 and 14. The Rx signal is generated across the transducer 10. The transducer 10 converts the Rx signal into an audio signal that is output in the ear canal of the operator. The Rx signal is also output from the outputs of op amps 12 and 14.

The transducer 10 provides an inductance and operates in conjunction with the resistance of resistor 36 to filter out low frequencies in the Rx signal that are generated across transducer 10. Because the transducer 10 generates a higher impedance at higher frequencies, more gain is provided by op amp 12 for the higher frequency components and less gain is generated for low frequency components of the Rx signal.

When the operator talks, the audio signals output through the ear canal of the operator are converted into an electrical Tx signal by transducer 10. The Tx and Rx signals 52 are output from op amp 12.

The op amp 14 is basically a resistive circuit that does not effect the phase of the output Rx signal 50. However, the op amp circuit 12 has a reactive inductive component created by transducer 10. The phase of the Rx signal 52 output from op amp 12 is therefore shifted from the phase of Rx signal 50 output from op amp 14. The Rx signal 50 output from op amp 14 and the Rx signal 52 output from op amp 12 are shown in FIG. 10.

The Tx and Rx signals 52 output from op amp 12 are converted into digital data by A/D 16. The Rx signal 50 output by op amp 14 is converted into digital data by A/D 18. An Rx adaptive phase canceller 19 aligns the phase of Rx signal 50 180 degrees out of phase with respect to the phase of Rx signal 52. The signal adder 20 then adds the 180 degree out of phase Rx signal from phase canceller 19 with the Tx+Rx signal 52 output from A/D 16. The output 21 of signal adder 21 has a substantially reduced Rx signal and primarily consists of the Tx signal. Alternatively, the phase canceller 19 could align the phase of Rx signal 50 with the phase of Rx signal 52. The signal adder 20 then could simply subtract the Tx+Rx signal output by A/D 16 from the Rx signal output from phase canceller 19 to substantially cancel out the Rx signal output by signal adder 20. The desired target reduction of the Rx signal output from the signal adder 20 is 30 decibels (dbs) below the Tx signal.

The Tx signal in converted back into an analog signal by D/A 22 then fed into the hybrid network 24 of the telephone system. The Tx signal is then output on the telephone line 25 or to the voice codec or other telephone circuitry that encodes the Tx signal for transmission over a landline or wireless voice channel of the telephone network.

Another objective of the communication circuit 8 is to compensate for the Tx signal that may leak through the hybrid network 24 back over the receive channel. When the telephone line 25 is converted from the 2 wires of the telephone line 25 to the 4 wires of the communication circuit 8, there are reactive effects in the hybrid network transformers that allow some of the Tx signal at input 21 to lead through the hybrid network 24 back to the input 23 of circuit 8.

The Rx signal plus the Tx signal leakage at input 23 are both fed into the A/D converter 26. The Tx signal from the output 21 of signal adder 20 is fed into the Tx adaptive phase canceller 28. The phase canceller 28 operates in the same manner as the phase canceller 19 only for the Tx signal instead of the Rx signal. In other words, the phase canceller 28 shifts the Tx signal at output 21 to 180 degrees out of phase with respect to the Tx signal at the input 23.

The signal adder 30 then adds the Rx+Tx (leakage) signal with the 180 degree phase shifted Tx signal output from adaptive phase canceller 28. The signal adder 30 subtracts the Tx signals and outputs primarily only the Rx signal. Any remaining Tx signal output from the signal adder 30 is about 30 dbs below the Rx signal.

In summary, the desired Tx signal at the output 21 of circuit 8 is 30 dbs higher than any Rx signal. Further, the Rx signal on line 34 is 30 dbs higher than any Tx signal on line 34.

Opposite Polarity Transducers

Figure 11:
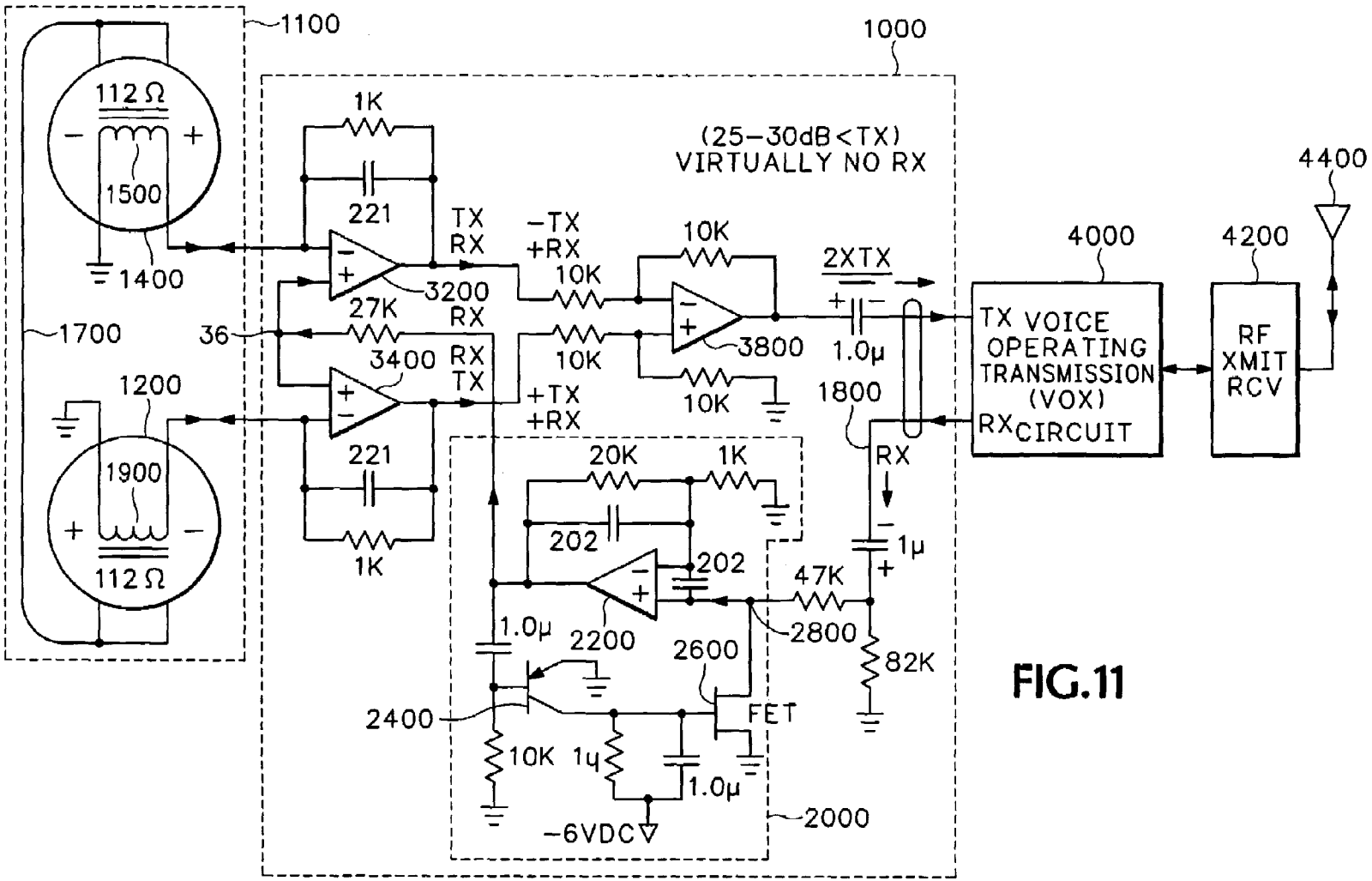
FIG. 11 is a schematic diagram of a full duplex transmit and receive circuit according to another embodiment of the invention.

Referring to FIG. 11, a transmit and receive circuit 1000 is coupled at a first end to a headset 1100. The headset 1100 includes headphones 1400 and 1200 that contain transducers 1500 and 1900, respectively. A strap 1700 holds the two headphones 1400 and 1200 together. The transducer 1500 is coupled between ground and the circuit 1000 in an opposite polarity than transducer 1900.

On the opposite end of the transmit and receive circuit 1000 is a voice operated transmission (VOX) circuit 4000. The VOX circuit 4000 detects a transmission signal (Tx) generated by the operator of headset 1100. When a sufficient Tx signal is detected, the VOX circuit 4000 activates a Radio Frequency (RF) transmit and receive device 4200 to transmit the Tx signal over antenna 4400 to a receiving device. When the Tx signal is not detected, the VOX circuit 4000 enables the transmit and receive device 4200 to receive any incoming receive signals (Rx).

In one example, the transmit and receive device 4200 is a two-way radio or walkie-talkie. However, it should be understood that the transmit and receive circuit 1000 operates with any two-way communication device 4200, including but not limited to cellular telephones, wireless phones, landline telephones, transceivers or walkie-talkies, etc. In the case of a telephone, the VOX circuit 4000 may not be needed.

The receive signal (Rx) on input 1800 from VOX 4000 is coupled to an automatic level control circuit 2000. The automatic level control circuit 2000 includes an op-amp 2200 coupled at an output to the base of a PNP transistor 2400. The output of transistor 2400 is coupled to the gate of a Field Effect Transistor (FET) 2600.

A voltage level is selected at input node 2800 of level control circuit 2000. If the Rx signal at node 2800 rises above a predetermined voltage threshold, the signal output from op-amp 2200 activates transistor 2400. That, in turn, increases the signal at the gate of FET 2600. The increased gate signal reduces the impedance between the source and drain terminals of FET 2600. The reduced impedance across FET 2600 pulls down the Rx signal at node 2800. Thus, the automatic level control circuit 2000 decreases the impedance across FET 2600 when the Rx signal at node 2800 increases above the threshold voltage. The Rx signal output from op-amp 2200 is in turn maintained at a constant level.

The Rx signal is output from automatic level control circuit 2000 to op-amps 3200 and 3400. The output of op-amp 3200 is coupled to the positive terminal of transducer 1500 in headphone 1400. The output of op-amp 3400 is coupled to the negative terminal of transducer 1900 in headphone 1200. The positive terminal of transducer 1900 is coupled to ground and the negative terminal of transducer 1400 is coupled to ground.

The Rx signal is fed into the op-amps 3200 and 3400 and back out to the transducers 1500 and 1900. Because the transducers 1500 and 1900 have reversed polarities, a listener will hear a negative Rx signal in one ear and a positive Rx signal in the other ear. In other words, the Rx signals output from the two headphones 1400 and 1200 are 180 degrees out of phase. However, it has been discovered that the human brain does not distinguish between the positive and negative Rx signals output by transducers 1500 and 1900. Thus, any incoming receive Rx signal output from headphones 1400 and 1200 sounds exactly the same in both ears of the headphone user. The Rx portion of the signal output from op-amps 3200 and 3400 are in phase. The two Rx signals fed into the negative and positive terminals of differential amplifier 3800 therefore cancel out.

When the user of headset 1100 talks, a Tx signal is output from transducer 1500 and the same Tx signal is output by transducer 1900. Because the transducers 1500 and 1900 are in reversed polarity, the two Tx signals output through op-amps 3200 and 3400 are out of phase. Therefore, the two Tx signals at the negative and positive terminals of differential amplifier 3800 are added together generating double the Tx signal (2Tx) at the output of op-amp 3800.

Figure 12:
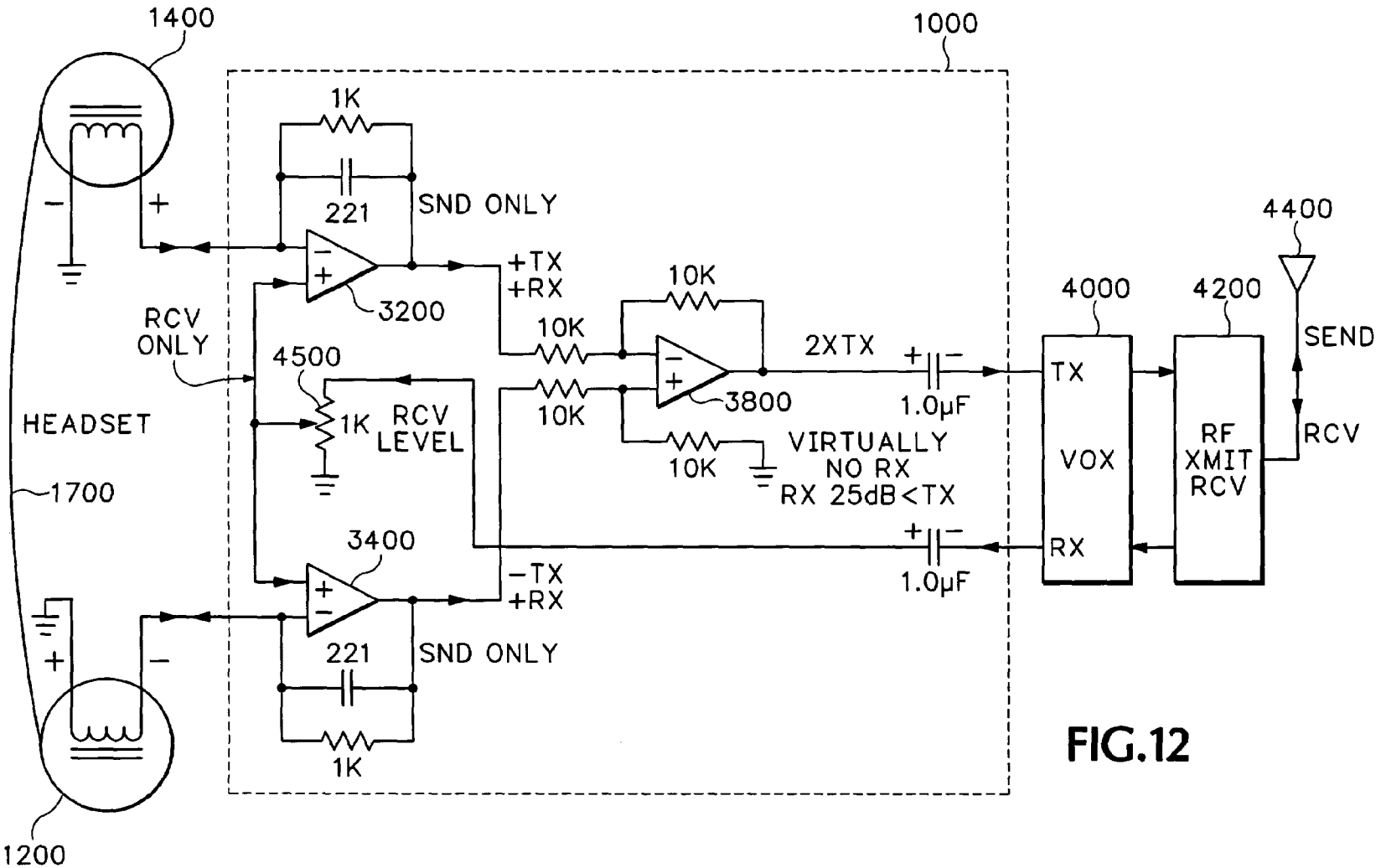
FIGS. 12, 13 and 14 are alternative embodiments of the full duplex circuitry.

FIG. 12 is an alternative embodiment of the full duplex circuit 1000 previously shown in FIG. 11. Instead of using an automatic level circuit 2000, a manual Rx level circuit 4500 is used to adjust the Rx voltage level into op-amps 3200 and 3400.

Because the Rx signal output from the two op-amps 3200 and 3400 are the same phase, the Rx signal will be cancelled by differential amplifier 3800. As described above, the Tx signals output from op-amps 3200 and 3400 are of opposite polarity coming out of op-amps 3200 and 3400. Therefore, the Tx signals into differential amplifier 3800 are added together generating a double the Tx signal.

Figure 13:
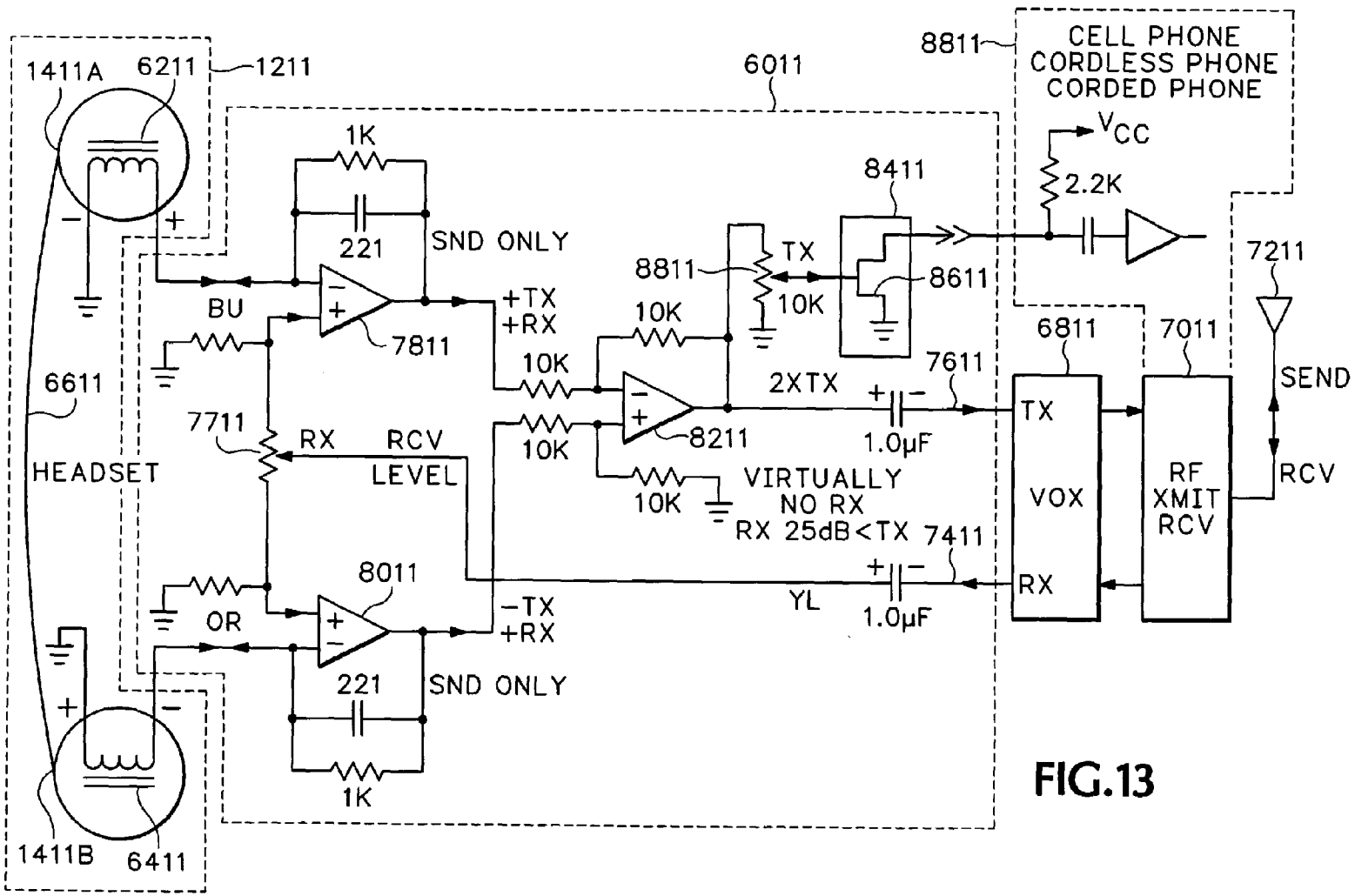

FIG. 13 shows another embodiment of the microphone and speaker circuit. A transmit and receive circuit 6011 is coupled at a first end to a headset 1211. The headset 1211 includes headphones 1411A and 1411B that contain transducers 6211 and 6411, respectively. A strap 6611 holds the two headphones 1411A and 1411B together. The transducer 6211 is coupled between ground and the circuit 6011 in an opposite polarity than transducer 6411.

On the opposite end of the transmit and receive circuit 6011 is a voice operated transmission (VOX) circuit 6811. The VOX circuit 6811 detects a transmission signal (Tx) generated by the operator of headset 1211. When a sufficient Tx signal is detected, the VOX circuit 6811 activates a Radio Frequency (RF) transmit and receive device 7011 to transmit the Tx signal over antenna 7211 to a receiving device. When the Tx signal is not detected, the VOX circuit 6811 enables the transmit and receive device 7011 to receive any incoming receive signals (Rx).

In one example, the transmit and receive device 7011 is a two-way radio or walkie-talkie. However, it should be understood that the transmit and receive circuit 6011 can operate with any two-way communication device 7011, including but not limited to, cellular telephones, wireless phones, landline telephones, transceivers, walkie-talkies, etc. In the case of a telephone, the VOX circuit 6811 may not be needed.

An Rx signal is input at terminal 7411 of circuit 6011 to op-amps 7811 and 8011. An Rx level circuit 7711 adjusts the Rx voltage level into op-amps 7811 and 8011. The output of op-amp 7811 is coupled to the positive terminal of transducer 6211 in headphone 1411A. The output of op-amp 8011 is coupled to a negative terminal of transducer 6411 in headphone 1411B. The positive terminal of transducer 6411 is coupled to ground and the negative terminal of transducer 6211 is coupled to ground.

The Rx signal is fed into the op-amps 7811 and 8011 and back out to the transducers 6211 and 6411. Because the transducers 6211 and 6411 have reversed polarities, a listener will hear a negative Rx signal in one ear and a positive Rx signal in the other ear. In other words, the Rx signals output from the two headphones 1411A and 1411B are 180 degrees out of phase. However, it has been discovered that the human brain does not distinguish between the positive and negative Rx signals output by transducers 6211 and 6411. Thus, any incoming receive Rx signal output from headphones 1411A and 1411B sounds exactly the same in both ears of the headphone user. The Rx portion of the signal output from op-amps 7811 and 8011 are in-phase. The two Rx signals fed into the negative and positive terminals of differential amplifier 8211 cancel out.

When the user of headset 1211 talks, a Tx signal is output from transducer 6211 and the same Tx signal is output from transducer 6411. Because the transducers 6211 and 6411 are in reversed polarity, the two Tx signals output through op-amps 7811 and 8011 are 180 degrees out of phase. Therefore, the two Tx signals at the negative and positive terminals of differential amplifier 8211 are added together doubling the Tx signal (2Tx) at the output of op-amp 8211.

An interconnect circuit 8411 is used to connect the transmit and receive circuit 6011 to different cellular, cordless and corded telephones 8811. The interconnect circuit 8411 includes a Field Effect Transistor (FET) 8611 having a gate coupled to an output of op-amp 8211 through a variable resistor 8811. The Tx signal passes from the output of op-amp 8211 to the gate of FET 8611. The FET 8611 varies the voltage across the 2.2 K resistor varying the Tx signal delivered to the telephony device 8811.

The transmit and receive circuit 6011 enables easier and clearer two-way communications. The circuit 6011 can be located in the headset 1211 or can be located in the two-way communication device 8811.

The transmit and receive circuit 6011 enables the transducers 6211 and 6411 in head phones 1411A and 1411B to operate as both microphones for picking up audio signals from the user and also operate as speakers for outputting received Rx signals. When a user of the headset 1211 speaks, audio signals are output through the user's ear canals. These audio signals are converted by the transducers 6211 and 6411 in headphones 1411A and 1411B into Tx signals. Because the Tx signals are generated by the headphones, there is no need to mount a separate microphone on a boom in front of the users mouth.

Further, because the audio signals from the user are output from the ear canals and directly into the headphones 1411A and 1411B, there is significantly less outside ambient noise that is picked by transducers 6211 and 6411 when operating as microphones. As a result, the user's voice signals comprise a larger and clearer part of the generated Tx signal.

Headphones 1411A and 1411B in one embodiment have foam pads that have been found to work exceptionally well in filtering ambient noise from the transceivers. However, any commercially available headset can be adapted to be used with the transmit and receive circuit 6011 including earphones that insert into the user's ear canal. Because no separate microphone boom is required, the full duplex headphones are also less expensive to manufacture and easier to operate.

Figure 14:
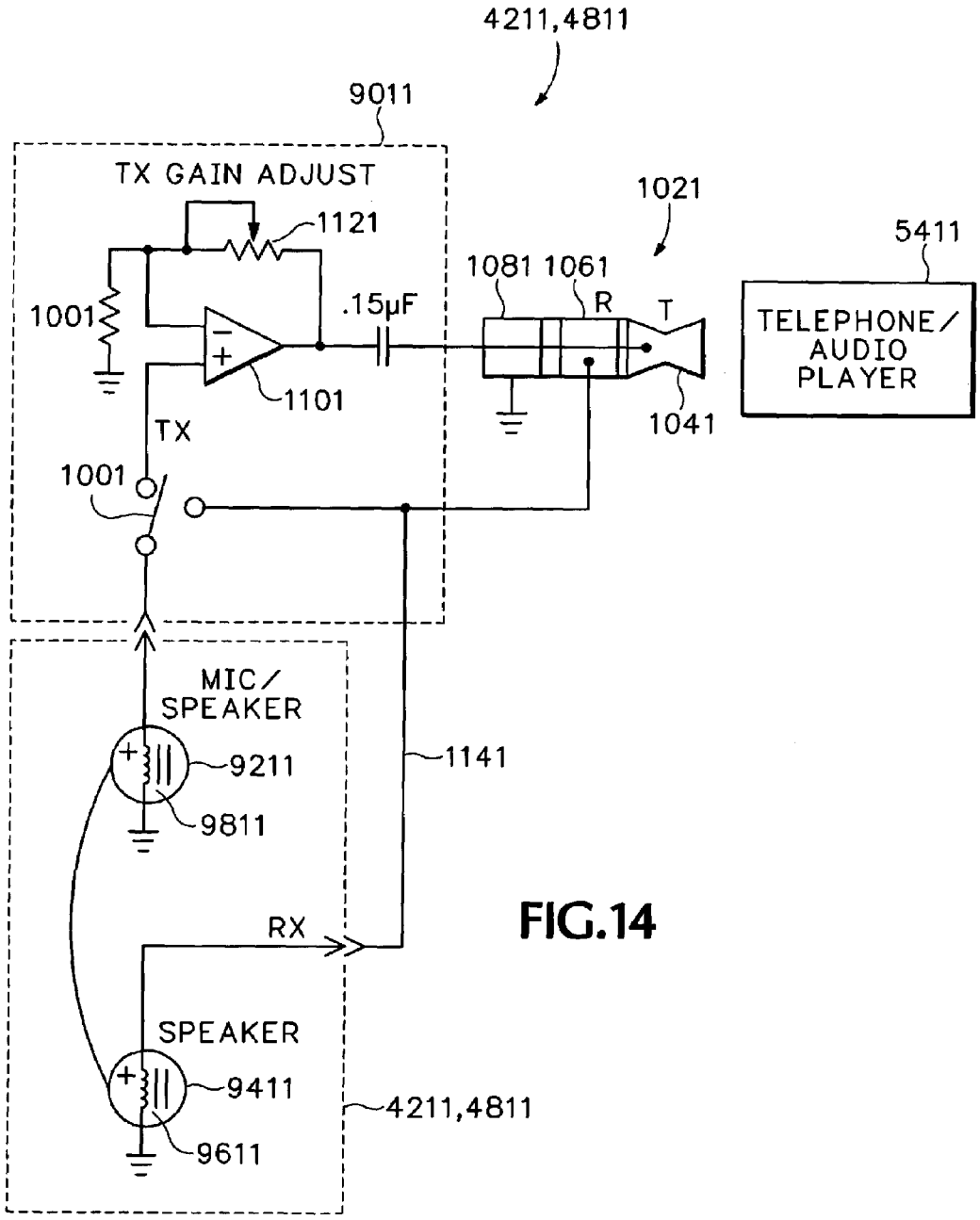

FIG. 14 shows another embodiment of the headset circuitry. A first headphone or earphone 9411 includes a transducer 9611 that operates as a speaker. A headphone or earphone 9211 includes an electret microphone 9811. A rubber housing is located between the electret 9811 microphone and a housing for headphone or earphone 9211.

A plug 1021 includes a tip connection 1041, ring connection 1061 and a ground connection 1081. The microphone 9811 is coupled through a switch 1001 to an amplifier circuit 9011. The output of an amplifier 1101 is coupled through a capacitor to the tip connection 1041. A variable resistor 1121 varies the gain of amplifier 1101. The ring connection 1061 is coupled to both switch 1001 and transducer 9611. The amplifier circuit 9011 and switch 1001 can be located either in the headset 4211 or 4811 or in the device 5411.

The headset 4211 or 4811 operates as stereo speakers when the device 5411 operates as an audio player. In the audio player mode, an audio signal is received at the ring connection 1061 and fed through wire 1141 to transducer 9611. The switch 1001 is moved to the position where the received audio signal from wire 1141 is also connected to headphone 9211. In this configuration, both headphones or earphones 9211 and 9411 operate as speakers.

When the device 5411 is switched over to operating as a two-way communication device, such as a cellular telephone, switch 1001 connects headphone or earphone 9211 to amplifier 1101. The user of headset 4211 or 4811 talks during the telephone conversation using the cellular phone in device 5411. The user's voice signals are picked up by the microphone 9811 and output as a transmit Tx signal to amplifier 1101. The amplifier 1101 amplifies the Tx signal and outputs the transmit signal to the tip connection 1041 of jack 1021. Any received voice signals from the cellular telephone in device 5411 are received on the ring connection 1061 of jack 1021 and are output to the transducer 9611.

Thus the headset 4211 or 4811 provides stereo speakers when the device 5411 is being used as an audio player. When the device 5411 is switched over to operating as a two-way communications device, the headphone or earphone 9211 switches over to operating as a microphone. The headphone or earphone 9211 generates the Tx signal from the voice of the user while headphone or earphone 9411 continues to operate as a speaker for outputting Rx signals to the user.

Figure 15:
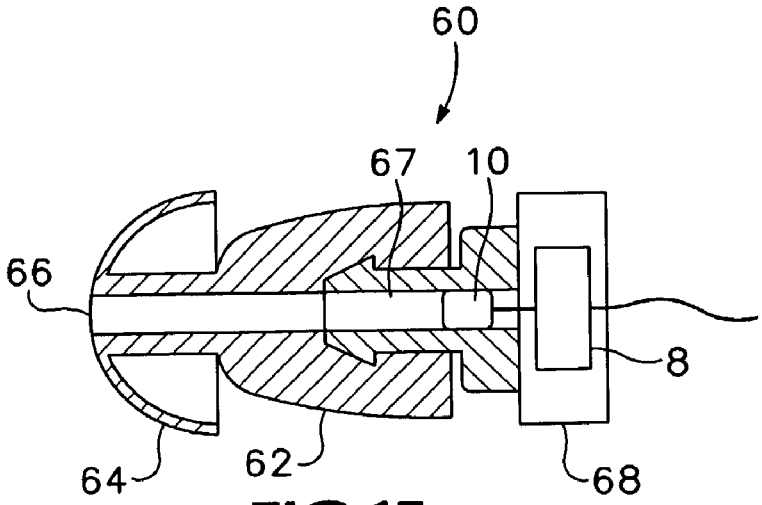
FIG. 15 shows a cross-sectional view of an earpiece that contains the full duplex circuitry.
Figure 17:
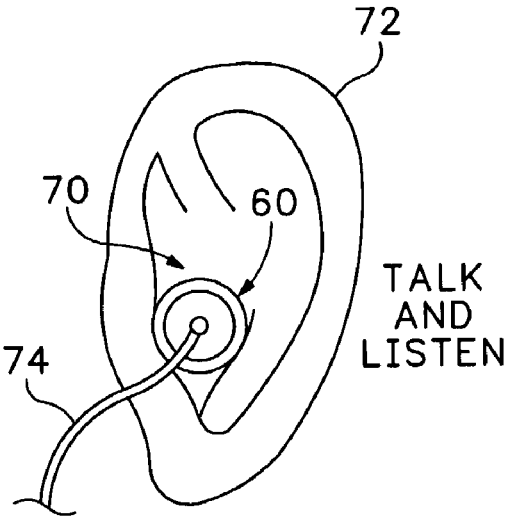
FIG. 17 shows how the earpiece in FIGS. 15 and 16 rests within an ear of an operator.

FIG. 15 shows one example of how the communication circuits in FIGS. 8–14 are incorporated into an earpiece 60. This particular configuration is especially effective in high noise environments because the earpiece 60 has a nipple 62 that penetrates into and fits snuggly within the operator's ear canal 70 (FIG. 17). The nipple 62 includes an umbrella-like shroud 64 made of a soft, flexible material, such as a rubber or plastic, that conforms to the shape of the external auditory canal. The pinnacle of the shroud 64 has an opening 66 that allows air to pass through the shroud 64 and nipple 62 to the transducer 10 within an earpiece housing 68. A stalk 67 of housing 68 is inserted into the nipple 62 and is made of a hard plastic. The rest of the communication circuit 8 is located either in the earpiece housing 68 or located in the phone that the earpiece 60 is connected with.

Figure 16:
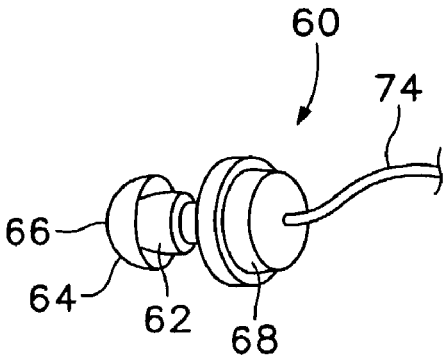
FIG. 16 shows a perspective view of the earpiece shown in FIG. 15.

FIG. 16 shows a perspective view of the nipple earpiece 60 shown in FIG. 15. The nipple 62 snaps onto the earpiece housing 68 that houses the transducer 10 and possibly all or a part of the remaining components of the communication circuit 8.

FIG. 17 shows an expanded view of the earpiece 60 resting within an ear 72 of an operator. This particular illustration shows how the earpiece 60 rests within a pocket of the ear such that the opening 66 in earpiece 60 is oriented in the direction of the external ear canal 70. The earpiece 60 extends out of the ear and acts as a conduit for a cord 74 carrying the wires from the transducer 10 or communication circuit 8 inside the earpiece.

The earpiece 60 described above provides hands-free full duplex communications without having to use a microphone extension arm. A microphone does not have to be positioned near the mouth since the voice sounds are essentially provided through the ear canal. Also the same transducer 10 is used for both detecting voice signals from the operator while the operator is talking and also for generating audio signals to the operator from audio signals received from a wireless or landline telephone system. Thus, only one earpiece has to be inserted into the ear of the operator.

Multiple transducer housing styles can be used to suit the various preferred choices of use. An earpiece attachment that protrudes outside the ear canal can be used for less noisy environments. Two earpieces can be used, one used as a microphone and one as the ear phone.

The lightweight ear microphones use small miniature electro-dynamics transducers weighing approximately 5 grams or 0.18 oz. to minimize fatigue. The lightweight piezoelectric transducers further improve performance and reduce weight. Lightweight head bands, ear supports, and contoured transducer housings, such as those designed for security personnel, and the hearing impaired, provide snug fit in the outer ear canal.

Applications for the Microphone/Speaker Headset

Figure 18:
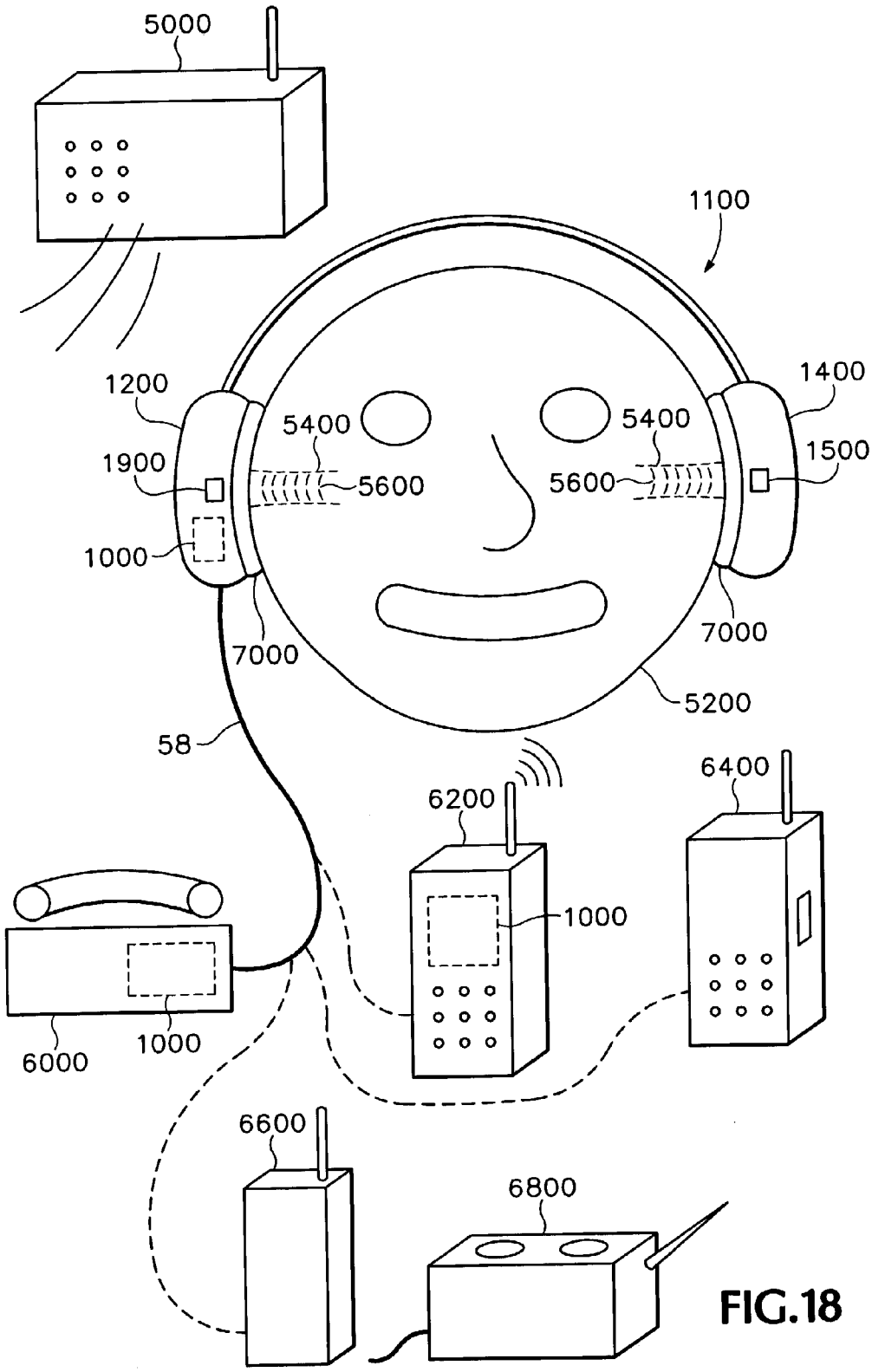
FIG. 18 is a diagram showing the full duplex circuitry used with various two-way communications devices.

Referring to FIG. 18, a microphone/speaker circuit 1000 can be located in the headset 1100 or can be located in the transmit and receive device. Any audio device can be used with the full duplex headphones and circuit 1000. For example, a landline based telephone 6000, a cellular telephone 6200, a wireless telephone 6600 or a walkie-talkie 6400. The headset 1100 can be utilized with anyone of these devices, or any other device that requires two-way communications.

The transmit and receive circuit 1000 enables the transducers 1900 and 1500 in head phones 1200 and 1400 to operate as both microphones for picking up external Tx audio signals and speakers for outputting received Rx signals. When a user 5200 of the headset 1100 speaks, audio signals 5600 are output through the user's ear canals 5400. These audio signals 5600 are converted by the transducers 1500 and 1900 in headphones 1200 and 1400 into Tx signals.

Because the audio signals from the user 5200 are output from the ear canals 5400 and directly into the cups of headphones 1200 and 1400, there is significantly less outside ambient noise that is picked by transducers 1900 and 1500. For example, the noise from a radio 5000 is significantly filtered user 5200's voice signals 5600. As a result, the user's voice signals 5600 comprise a larger and clearer part of the generated Tx signal.

Headphones 1200 and 1400 have foam pads 7000 that have been found to work exceptionally well in filtering ambient noise from the transceivers. However, any commercially available headset can be adapted to be used with the transmit and receive circuit 1000 including earpieces that insert into the ear canal. Because no separate microphone boom is required, the full duplex headphones are also less expensive to manufacture and easier to operate.

Figure 19:
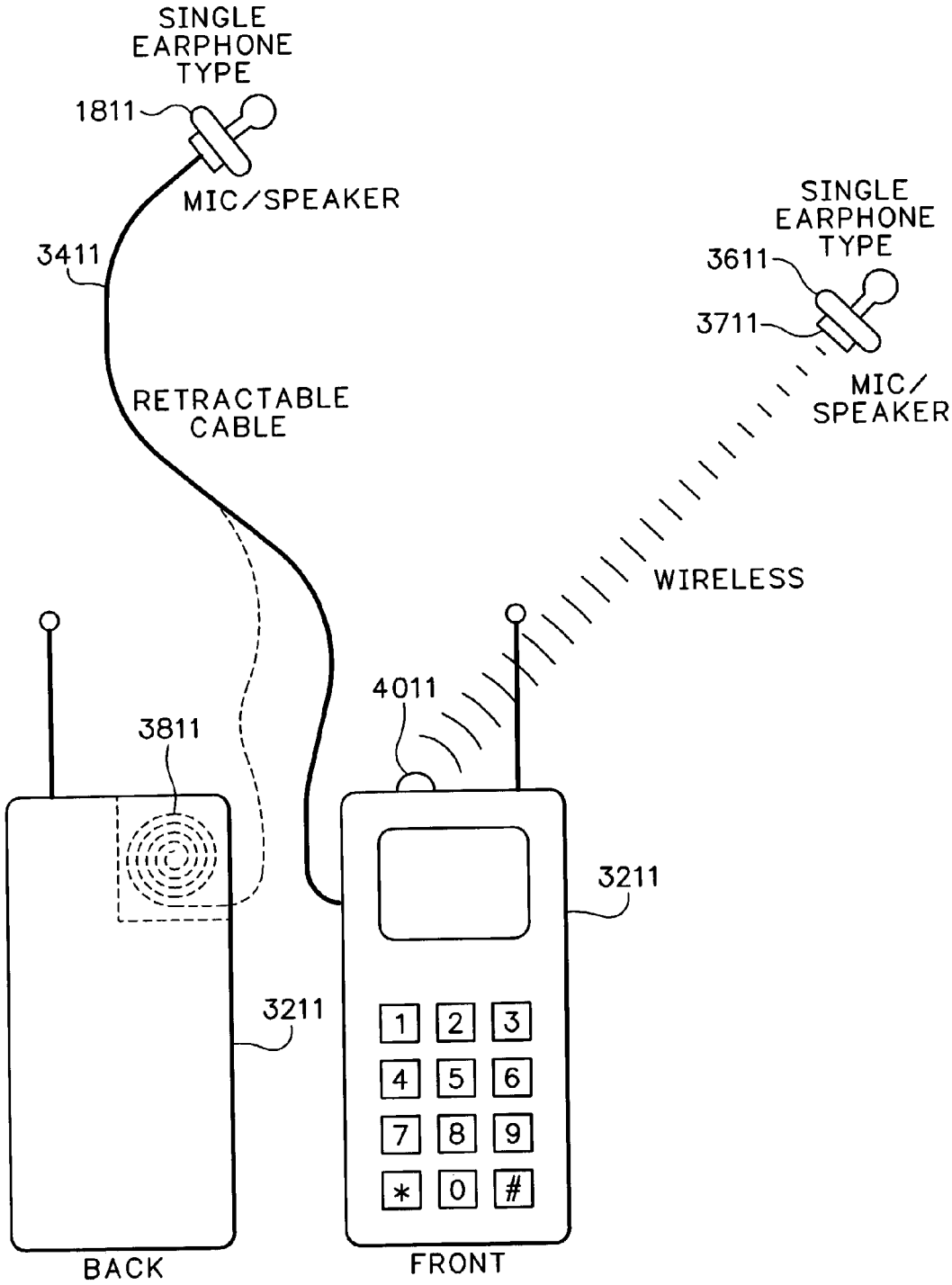
FIG. 19 is a diagram of a retractable earphone and a wireless earphone that operate as both a speaker and a microphone.

FIG. 19 shows a single earphone type headphone 1811. The earphone 1811 includes a transducer that operates as both a microphone and a speaker as described above. The earphone 1811 is attached to a cord 3411. An opposite end of the cord 3411 is connected to a retractable take-up reel 3811. The take-up reel 3811 is located inside of a cellular telephone 3211 or any other two-way communication device.

The cord 3411 is pulled out from reel 3811 as far as needed for a user to insert earphone 1811 into the user's ear canal. The reel 3811 includes a latch (not shown) that holds the cord at the extended position. When the user is finished with the earphone 1811, the cord is pulled further out from the reel 3811. The latch then releases the reel 3811 and allows the reel 3811 to retract the cord 3411 back into the cellular telephone. Alternatively, a button on cellular telephone 3211 can be used to release the reel 3811 allowing retraction of cord 3411.

In an alternative embodiment, an earphone 3611 includes a wireless transceiver 3711. A transducer in earphone 3611 converts a user's voice into electrical Tx signals. A transceiver 3711 in the earphone 3611 transmits the Tx signals wirelessly to another transceiver 4011 in cellular telephone 3211.

Rx signals received by the cellular telephone 3211 from another caller are transmitted by transceiver 4011 to transceiver 3711 in earphone 3611. The transducer in earphone 3611 then converts the Rx signals into audio signals. The wireless signals transmitted and received by the transceivers 4011 and 3711 use any frequencies to transmit the Tx and Rx signals. For example, the same frequencies and circuitry used by wireless telephones for wireless Tx and Rx transmission and reception.

Figure 20:
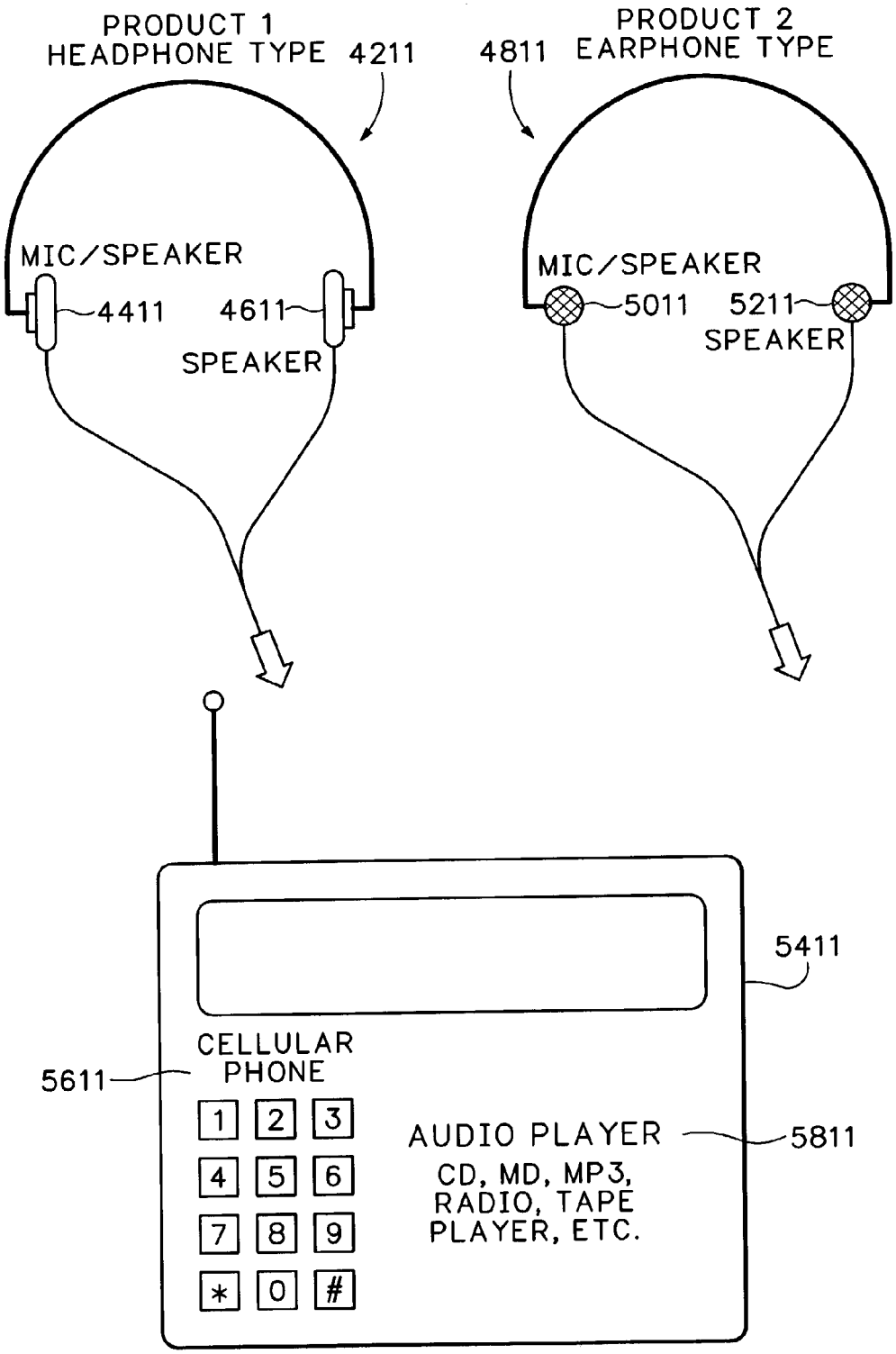
FIG. 20 is a diagram of a headset that has two headphones or earphones that operate as speakers when connected to an audio device and one of the headphones or earphones switches to operating as a microphone when the device operates as a two-way communication device.

FIG. 20 shows a device 5411 that includes both a cellular telephone 5611 and an audio player 5811. The audio player 5811 can be any one or any combination of audio playing devices such as a CD player, MD player, MP3 player, radio, cassette tape player, etc. The cellular telephone 5611 can alternatively be a two-way radio or any other type of two-way communication device.

The headsets 4211 and 4811 operate as stereo headphones when the device 5411 is used as an audio player and operate as a separate microphone and speaker when the device 5411 is used as a telephone as previously described in FIG. 14.

Headphone 4411 in headset 4211 or earphone 5011 in headset 4811 operates as a microphone when the device 5411 is used as a cellular telephone. Headphone 4411 or earphone 5011 operates as a speaker when the device 5411 is operating as an audio player. Headphone 4611 or earphone 5211 operates as a speaker for both the cellular telephone 5611 and audio player 5811.

Since headphone 4411 and earphone 5011 each operate as either a microphone or a speaker, the headsets 4211 and 4811 provide stereophonic sound when the device 5411 is using the audio player 5811. When the device 5411 switches over to using the cellular telephone 5611, the headphone 4411 and the earphone 5011 automatically switch over to operating as microphones. The transducer in headphone 4411 or earphone 5011 picks up the voice signals coming from the user's ear canal and converts those voice signals into a Tx signal that is sent to the cellular telephone 5611 for transmission over a cellular telephone channel. When the device 5411 is switched back to operating audio player 5811, the headphone 4411 or earphone 5011 switches back to operating as a speaker.

Figure 21:
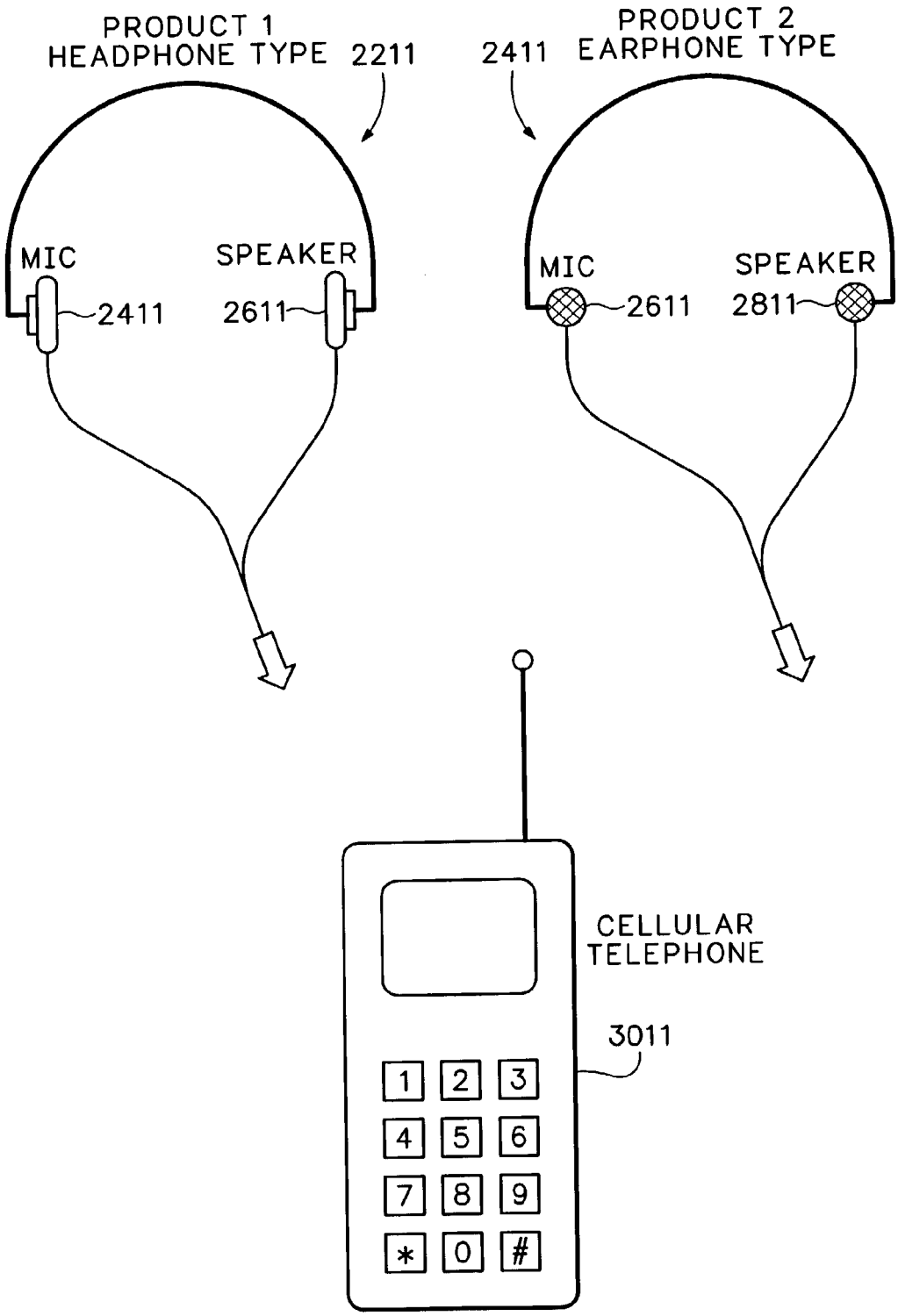
FIG. 21 is diagram of a headset where one headphone or earphone operates as a microphone and the other headphone or earphone operates as a speaker.

FIG. 21 shows headsets 2211 and 2411 that each has one headphone 2411 or earpiece 2611, respectively, that operates as a microphone and another headphone 2611 or earpiece 2811 that operates as a speaker. The headsets 2211 and 2411 are shown being used with a cellular telephone 3011 but can be used with any two-way communications device, such as a two-way radio, wireless telephone or landline telephone.

Figure 22:
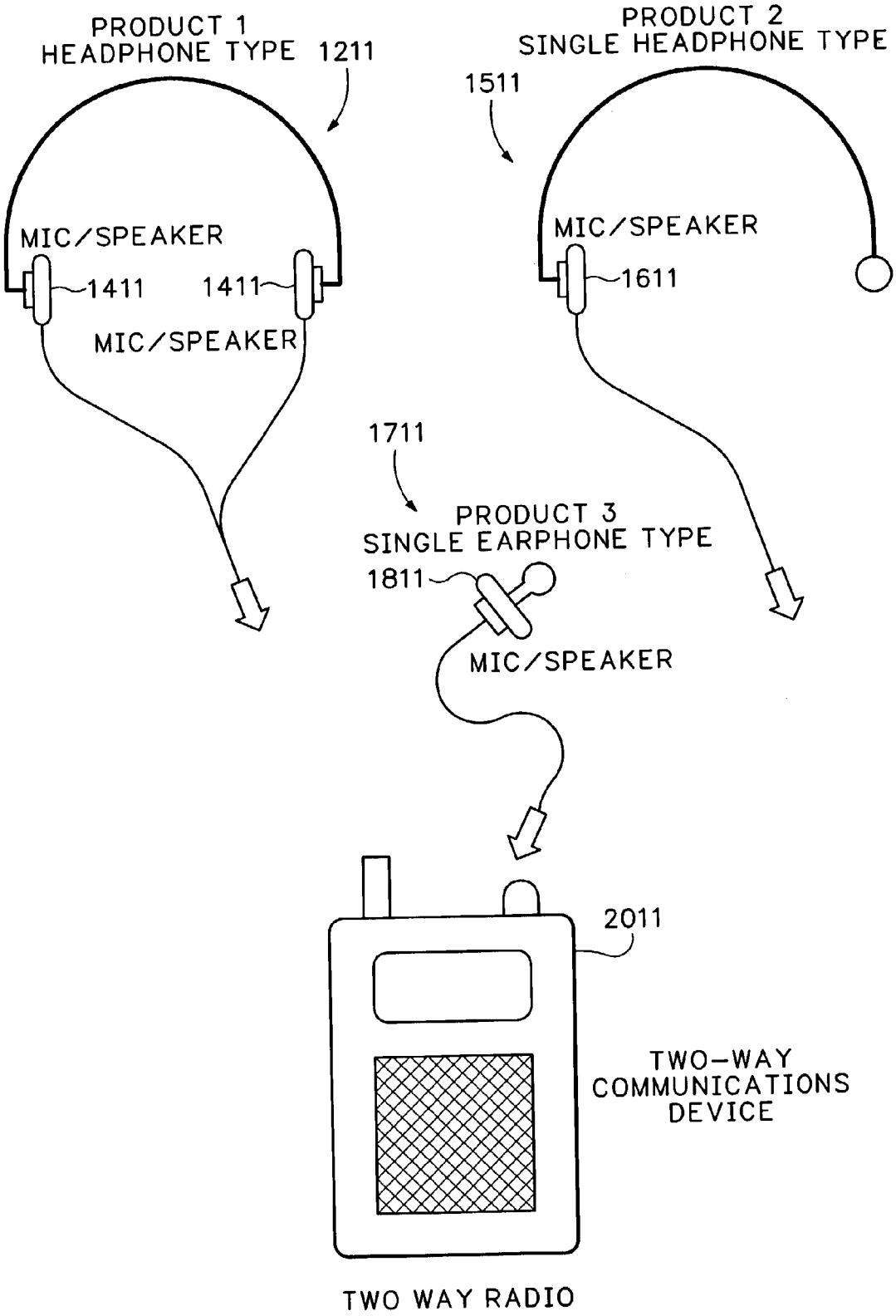
FIG. 22 is a diagram of the headset where each headphone or earphone operates as both a microphone and speaker.

FIG. 22 shows a headset 1211 having two headphones 1411 that each operate as both a speaker and a microphone. The headphone is connected to a two-way communications device 2011, such as a two-way radio, telephone, cellular phone, etc. Headset 1511 includes a single headphone 1611 that operates as both a microphone and speaker. A single earphone type headset 1711 includes an earphone 1811 that includes a transducer that operates as both a microphone and speaker as described above.

Figure 23:
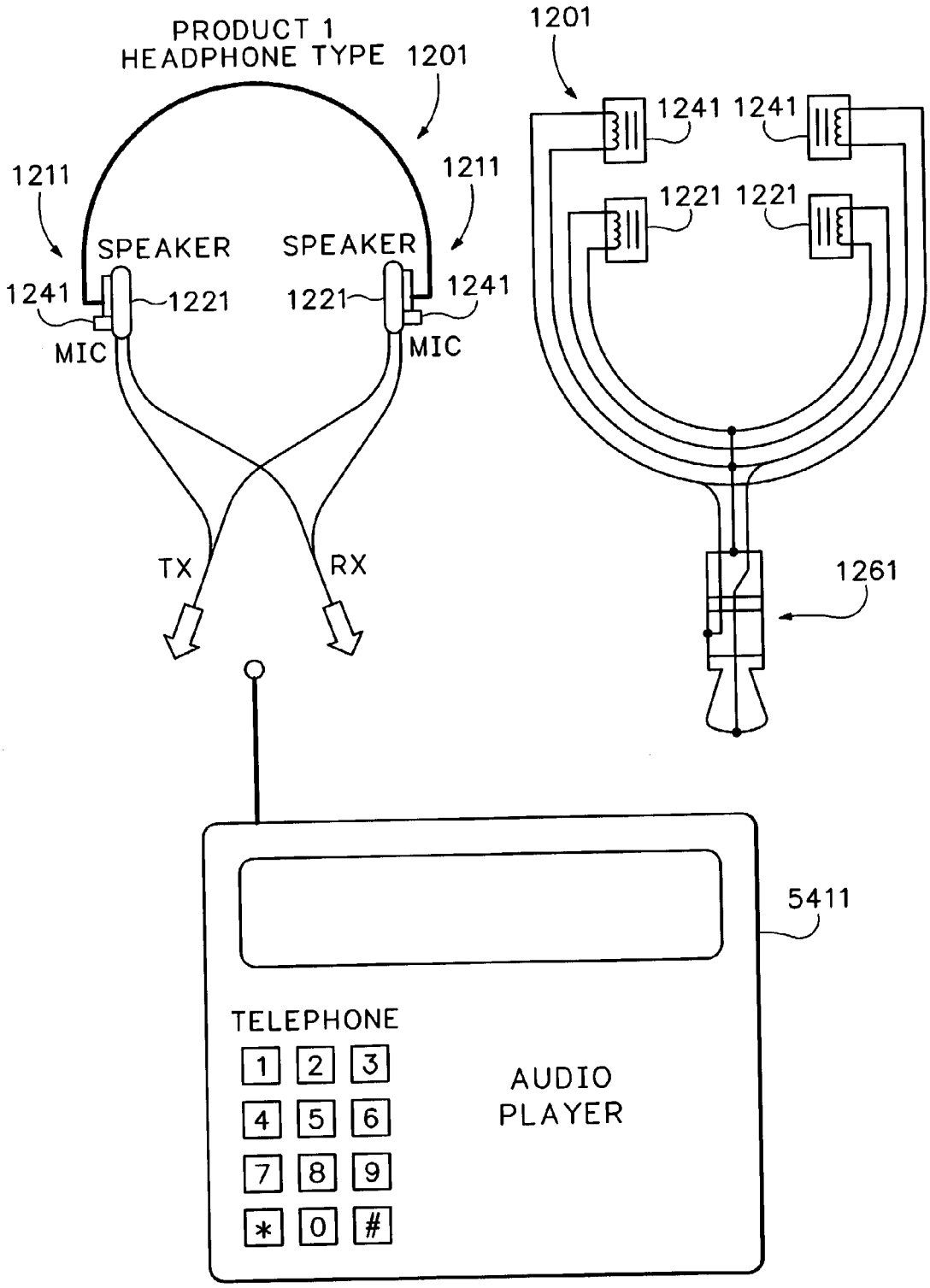
FIG. 23 is a diagram of a headset that has speakers inside the headphones and microphones attached to the outside of the headphones.

FIG. 23 shows another embodiment of a headset 1201 that can be used with the dual telephone/audio player device 5411 or any other two-way communications device. Headphones 1211 include transducers 1221 that serve as stereo speakers for outputting audio signals from the audio player in device 5411. The transducers 1221 also output any received Rx signals from the cellular telephone in device 5411.

Two separate microphones 1241 are located on the outside of the headphones 1211 and pickup audio signals while the user of headset 1201 is speaking. The microphones 1241 generate a transmit Tx signal that is output to the cellular telephone in device 5411. When the device 5411 operates as an audio player, the microphones 1241 are disabled.

The microphones 1241 and speakers 1221 are connected to a jack 1261 that plugs into device 5411. Any combination of microphones 1241 and speakers 1221 can be used. For example, the headset 1201 may have two speakers 1221 and only one microphone 1241 located on the outside of one of the headphones 1211. Alternatively, there may only be one headphone or earphone with only one microphone 1241 and only one speaker 1221. Whatever the configuration, the headset 1201 provides two-way communications when the device 5411 is operating as a cellular telephone and outputs mono or stereo sound when the device 5411 operates as an audio player.

Full Duplex Headset with Voice Recognition System

Figure 24:
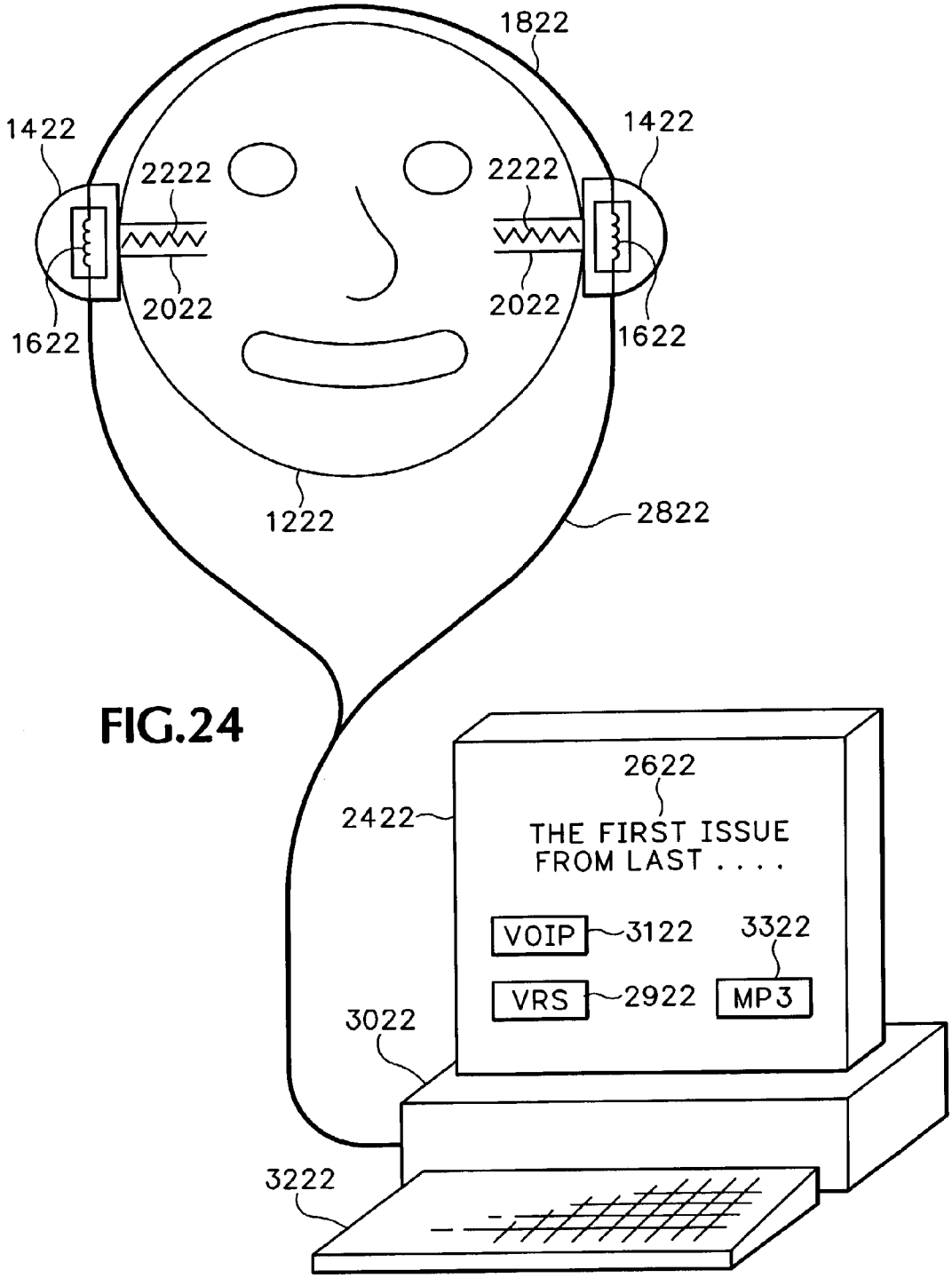
FIG. 24 is a diagram of a headset that detects sound waves from an ear canal and sends electrical signals generated from the sound waves directly to a Voice Recognition System.

Referring to FIG. 24, a headset 1822 includes two headphones 1422. The headphones 1422 can both operate as microphones, or can both operate as microphones/speakers, or one headphone 1422 can operate as a microphone while the other headphone 1422 operates as a speaker. The headset 1822 can use any of the full duplex circuits described above or any headset that includes a microphone that converts voice signals 2222 into electrical signals. The headphones 1422 each include a transducer 1622 that operates in one mode of operation as a microphone. In one embodiment, the transducer 1622 is a miniature piezoelectric, electret type, transducer. However, it should be understood that any type of transducer can be used.

While the operator 1222 is talking, the transducers 1622 detect the voice signals 2222 that pass out through the ear canals 2022 inside the head of operator 1222. The transducers 1622 convert the voice signals 2222 into electrical transmit Tx signals that are coupled through cables 2822 to a computer 3022.

By locating one or more microphones 1622 inside one or more of the headphones 1422, the voice signals 2222 from the operator's ear canal 2022 can be detected while at the same time filtering out unwanted ambient noise. Other unwanted noise from the user 1222, such as breathing noises, are also less of a problem because the microphone 1622 is no longer located on a boom underneath the users noise.

Software and a processor in the computer 3022 operate as a Voice Recognition System (VRS) 2922 and attempts to identify the words represented by the electrical Tx signals from cable 2822. The audio signals are interpreted by the VRS 2922 and displayed as words 2622 on the computer screen 2422. The VRS 2922 prevents the operator 1222 from having to manually type the words into the computer with keyboard 3222. The headset 1822 can be used for any Voice Recognition System that detects voice signals. Because, there is less noise in the Tx signals, the VRS 2922 is more likely to correctly identify the words coming from the operator's voice signals.

The headsets described in the references cited above can operate as both speakers that output received Rx signals to a user and microphones that transmit Tx signals from the operator's ear canal back to another endpoint. If the circuitry in headset 1822 operates as both a microphone and a speaker, the headset 1822 can be used with other applications other than VRS 2922. For example, the headset 1822 can also be used with any two-way communication device or application such as a cellular telephone, two-way radio, wireless phone, etc. The headset 1822 can also be used as a speaker for receiving audio signals from any CD, MD, MP3 or tape player.

For example, by selecting a different software application on the computer 3022, the computer can activate a Voice Over Internet Protocol (VoIP) phone application 3122, CD player, MD player, IP radio player, MP3 player 3322, or any other type of communication or audio playback application. The headset 1822 then not only generates the Tx signals output from the operator 1222 to the VRS application 2922 or VoIP application 3122 but also receives the Rx signals from any one of the sound playback applications referred to above.

It should also be understood that the microphone generating the Tx signals for the VRS application 2922 can be located inside any earphone, headphone, earpiece or any device or apparatus that goes inside or partially or fully covers the operator's ear or otherwise enables detection of voices signals from in the operator's ear canal 2022.

Figure 25:
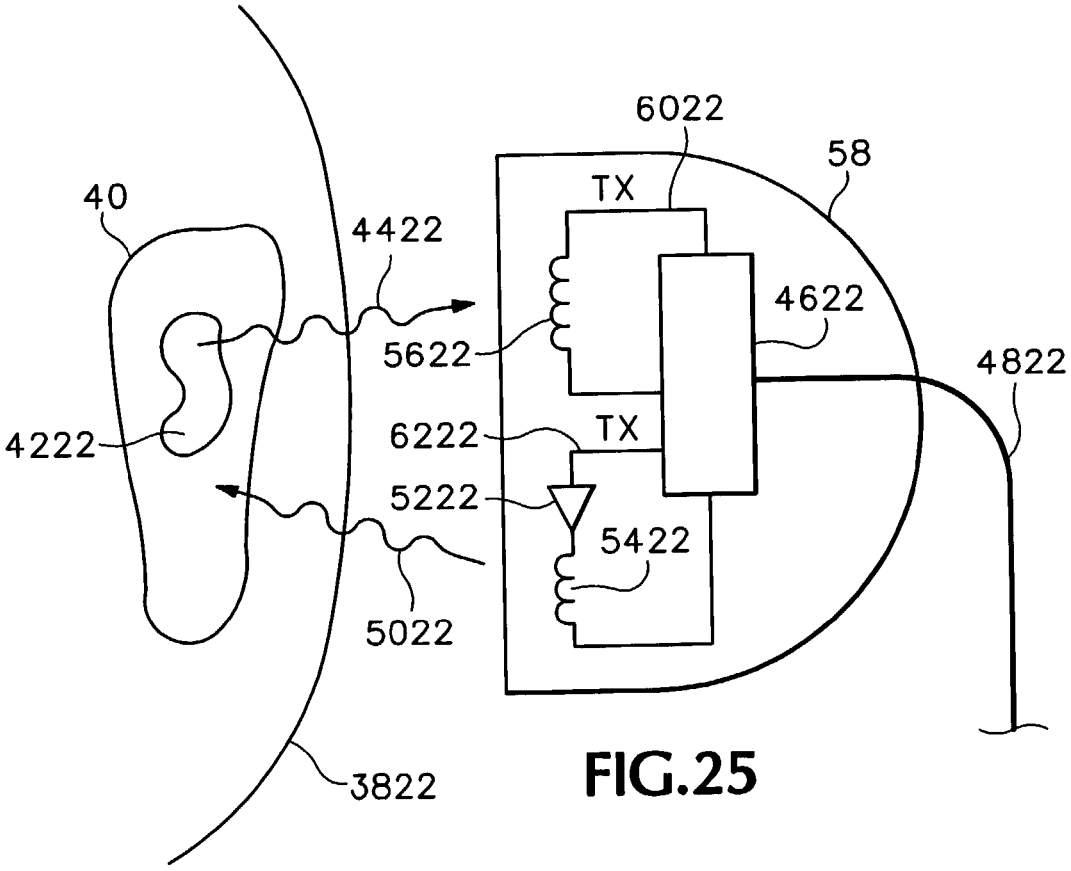
FIG. 25 is a headphone that feeds transmit signals back to the headphone operator.

FIG. 25 shows another embodiment of the invention that includes a first transducer 5622 that generates a Tx signal 6022 from the audio signals 4422 output from the ear canal 4222 of operator 3822. A circuit 4622 as described in any one of the full duplex circuits above increases the Signal to Noise Ratio of the Tx signal 6022 and then outputs the Tx signal on line 4822. The circuit 4622 in some embodiments of the referenced applications also allows the transducer 5622 to operate as a speaker.

While the transducer 5622 is operating as a microphone, it may be desirable to feedback the Tx signal to a speaker 5422. The Tx signal 6222 is output from speaker 5422 as voice signals 5022. This provides positive acknowledgement back to the operator 3822 that the voice signals 4422 are being successfully detected and output by transducer 5622 and circuit 4622. The feedback Tx signal 6222 may be further amplified by an amplifier 5222 before being fed to speaker 5422.

Loopdown and Looparound Headsets

Figure 26:
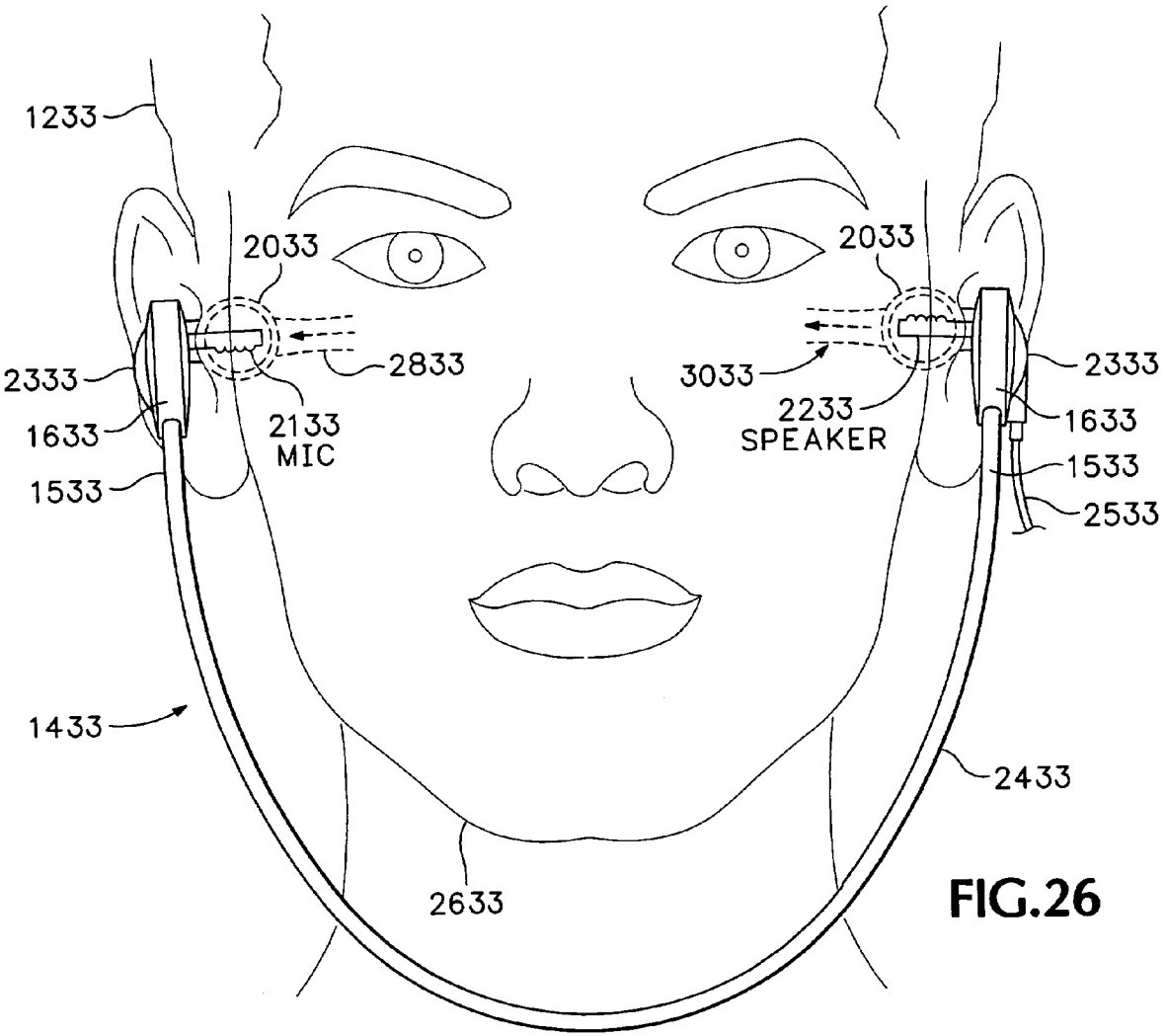
FIG. 26 is a front view of a loop down headset.
Figure 27:
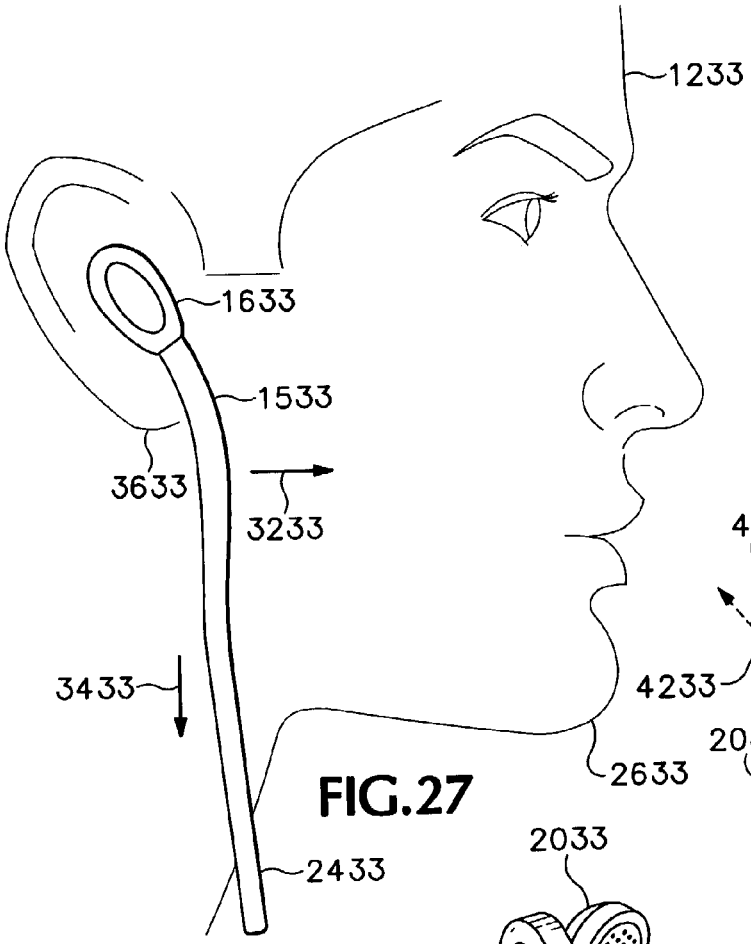
FIG. 27 is a side view of the loop down headset shown in FIG. 26.

FIGS. 26 and 27 show a loopdown headset 1433 that includes two earpieces 1633 for attaching to ears of an operator 1233. A band 2433 has opposite ends 1533 that connect to the two earpieces 1633. Earpieces 1633 include ear cups 2033 that insert into ear canals 2833 and 3033. A middle section of the band 2433 extends downwardly below a chin 2633 of a headset operator 1233. The band 2433 in one embodiment is made of a semi-rigid piece of plastic or metal.

While earpiece 1633 is shown with cups 2033, the shape of the strap and other aspects of the invention can be used with other types of earpieces. For example, the earpiece can comprise an earmuff style where the earpiece covers the entire outside ears of the operator and includes a foam pad that rests against the sides of the operator's head. Alternatively, a disc style earpiece can be used that may include a form pad that rests directly against the outside of the operator's ear without inserting directly into the ear. Other types of ear plugs or ear plunger style earpieces can also be used that insert directly into the ear canal of the operator.

In one embodiment of the headset 1433, a transducer 2133 operates as a microphone and is located either in one of the ear cups 2033 or in the main body section 2333 of earpiece 1633. The transducer 2133 is used to detect sound waves and bone conduction that is emitted through the ear canal 2833 when the operator 1233 is talking. The transducer 2133 converts the sound waves into electrical transmit signals that are output through a wire 2533 that extends inside of the band 2433. Another transducer 2233 operates as a speaker and is located either in another one of the cups 2033 or in the main body 2333 for another one of the earpieces 1633. The transducer 2233 converts electrical receive signals from wires 2533 into sound waves that are output into an opposite ear canal 3033 of the operator 1233. Any of the alternative full duplex circuits described above can also be used.

The side view of the loopdown headset 1433 in FIG. 27 shows how the ends 1533 of band 2433 extend in a slightly forward direction 3233 toward the front face of operator 1233. The middle potion of the band 2433 then loops in a downward direction 3433 underneath the chin 2633 of operator 1233. The ends 1533 of the band 2433 curve forward to extend in front of the earlobes 3633 of the operator 1233. This forward bend and downward loop in the band 2533 in combination with the position of the cups 2033 provide superior fit and comfort of the earpieces 1633 in the ears of the operator 1233. The forward curving ends 1533 also prevent the band 2433 from rubbing against earrings that the operator may be wearing.

Figure 28:
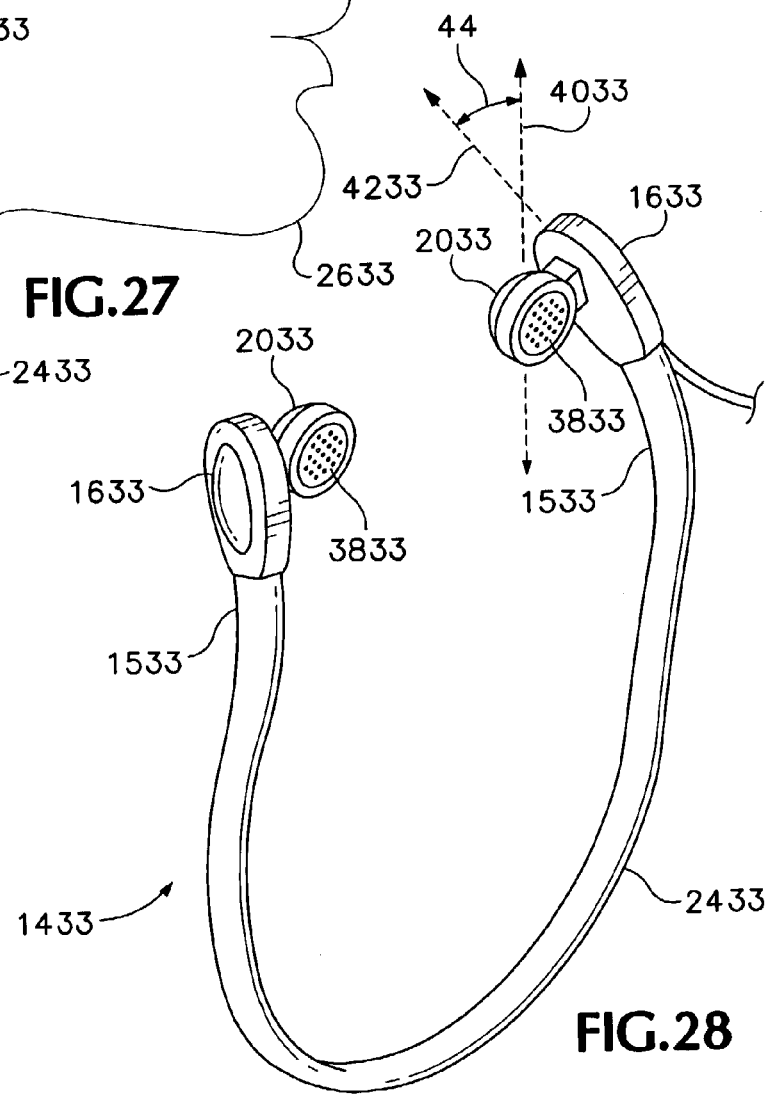
FIG. 28 is a perspective view of the loop down headset.
Figure 29:
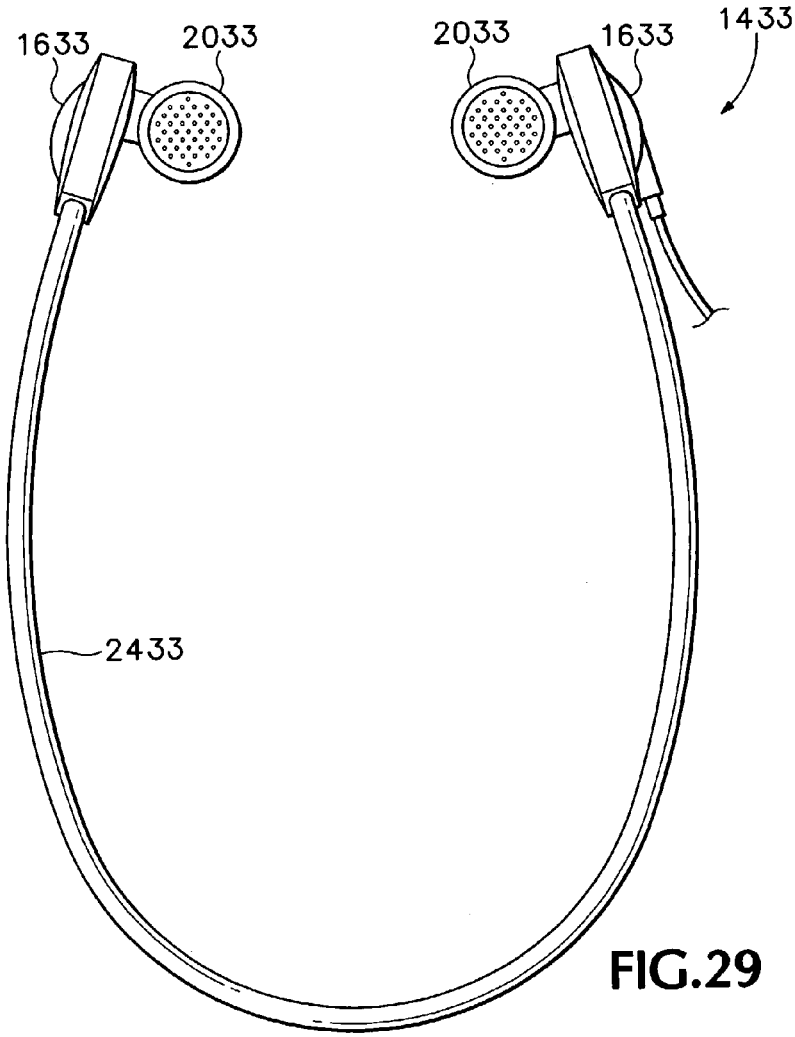
FIG. 29 is a front view of the loop down headset.

FIGS. 28 and 29 show in further detail the position of cups 2033 in relationship to the forward and then downward direction of band 2433. The cups 2033 each have a front face 3833 that extends substantially along a vertical plane 4033. The opposite ends of the band extend longitudinally along a line 4233 at an angle anywhere between 5 degrees to 45 from the vertical plane 4233.

Referring to FIGS. 26–29, the headset 1433 is pulled slightly outward at opposite ends 1533 by the operator. The head of the operator is then slid between the opposite ends 1533. The elastically deformable band 2433 then retracks toward its original position as the earpieces 1633 are inserted into ears of the operator. In the attached position, the opposite ends 1533 extend forward and then downward from the ears of the user.

The transducer microphone 2133 detects sound waves coming from the first ear canal 2833 while the operator 1233 is speaking. Because, the ear cup 2033 is located inside the ear canal 2833, there is little or no pickup of ambient noise. The speaker transducer 2233 converts electrical receive signals into sound waves that are output into the second ear canal 3033 of the operator 1233.

Figure 30:
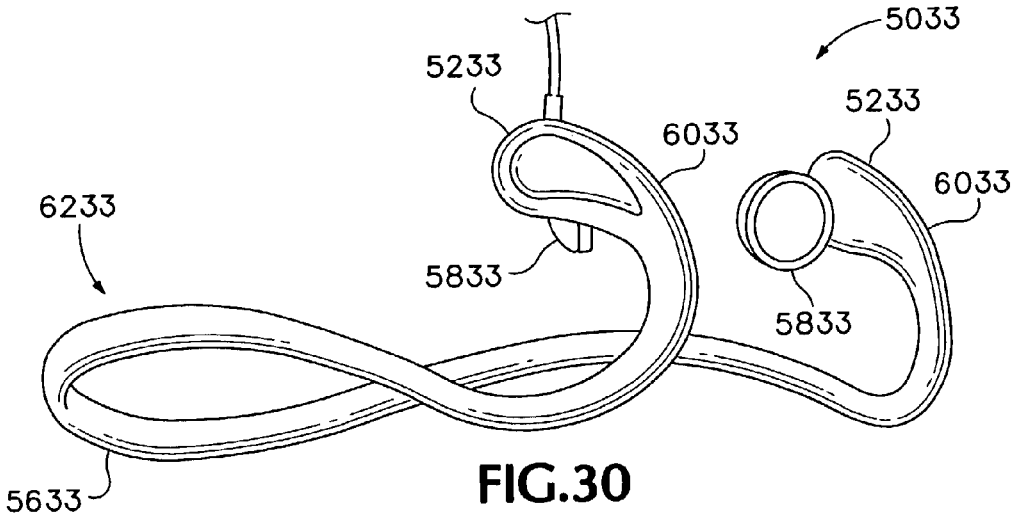
FIG. 30 is a perspective view of a loop back headset.
Figure 31:
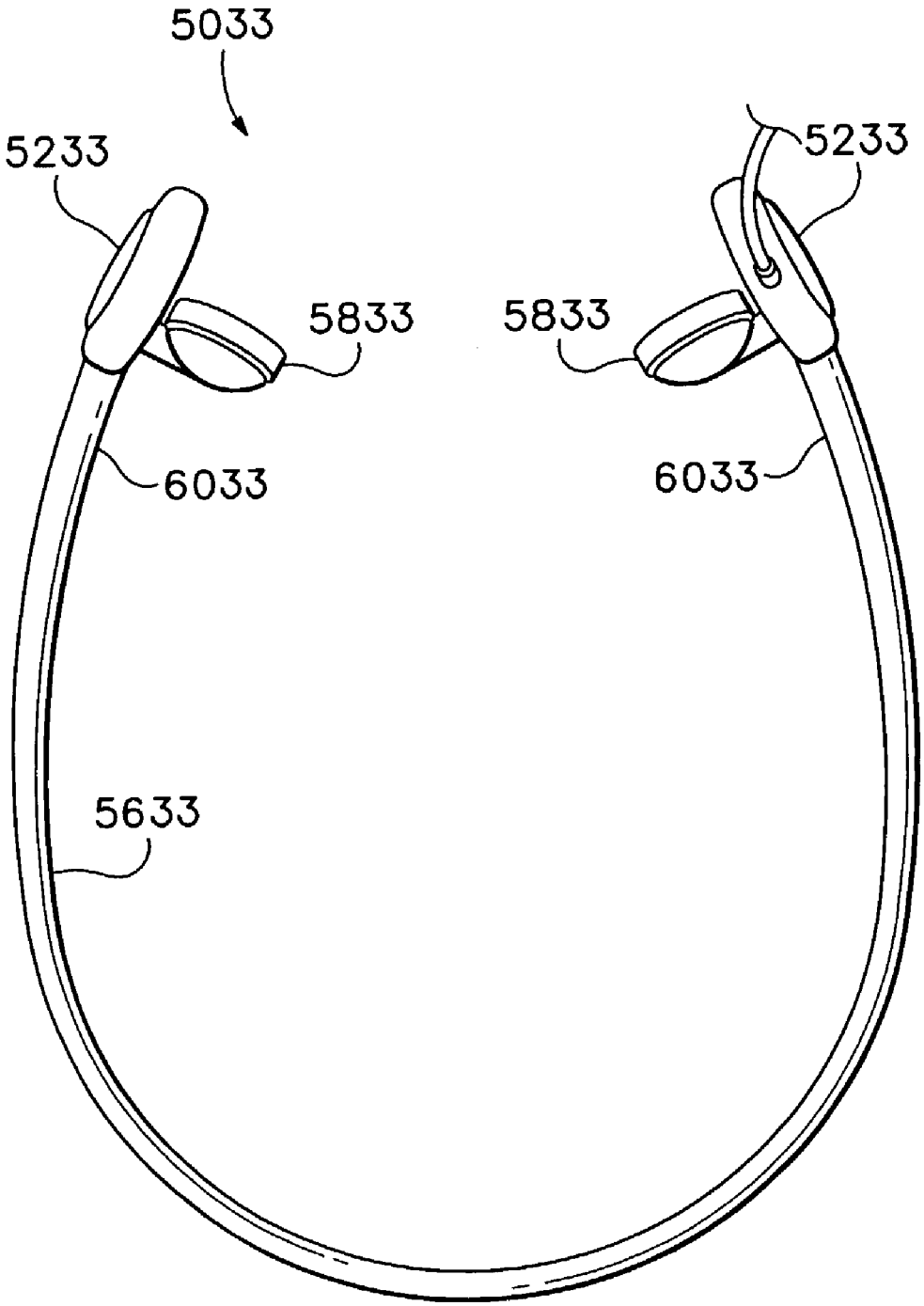
FIG. 31 is a top view of the loop back headset.
Figure 32:
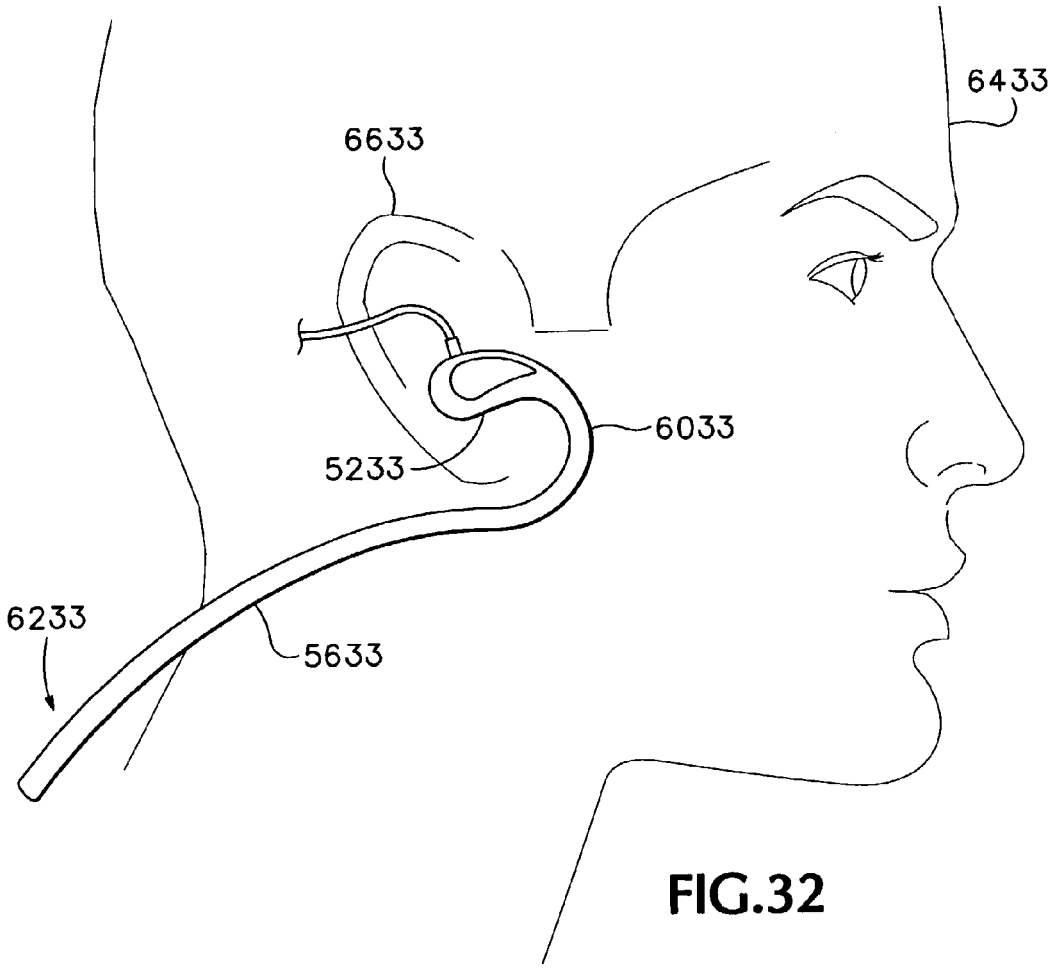
FIG. 32 is a side view of the loop back headset.

FIG. 30 shows a perspective view, FIG. 31 shows a top view, and FIG. 32 shows a side view for another embodiment of the invention. A headset 5033 includes earpieces 5233 and a band 5633. The earpieces 5233 include cups 5833 similar to the cups 2033 shown in FIG. 26. The opposite ends 6033 of the band 5633 extend from the earpieces 5233 in a forward direction and then loop underneath ears 6633 of the operator.

A middle portion 6233 of the band 5633 extends back around a backside of the neck of the operator 6433. This provides the additional advantage of obscuring the middle portion 6233. For example, long hair or a shirt or coat may hide a portion of the band 5633. This provides a more aesthetically appealing look for the operator 6433. In addition, the band 5633 remains out of reach of others. For example, if operator 6433 was holding a child, the child could not reach up and grab the band 5633 since it is positioned behind the neck.

Again the forward and then downward direction of opposite ends 6033 of the band provide superior comfort and retention of the cups 5833 inside the operators ears. In addition, because the ends 6033 loop underneath the ear 6633, the band 5633 will not rub up against earrings or other article that may be attached to the ears 6633 of the operator 6433.

Figure 33:
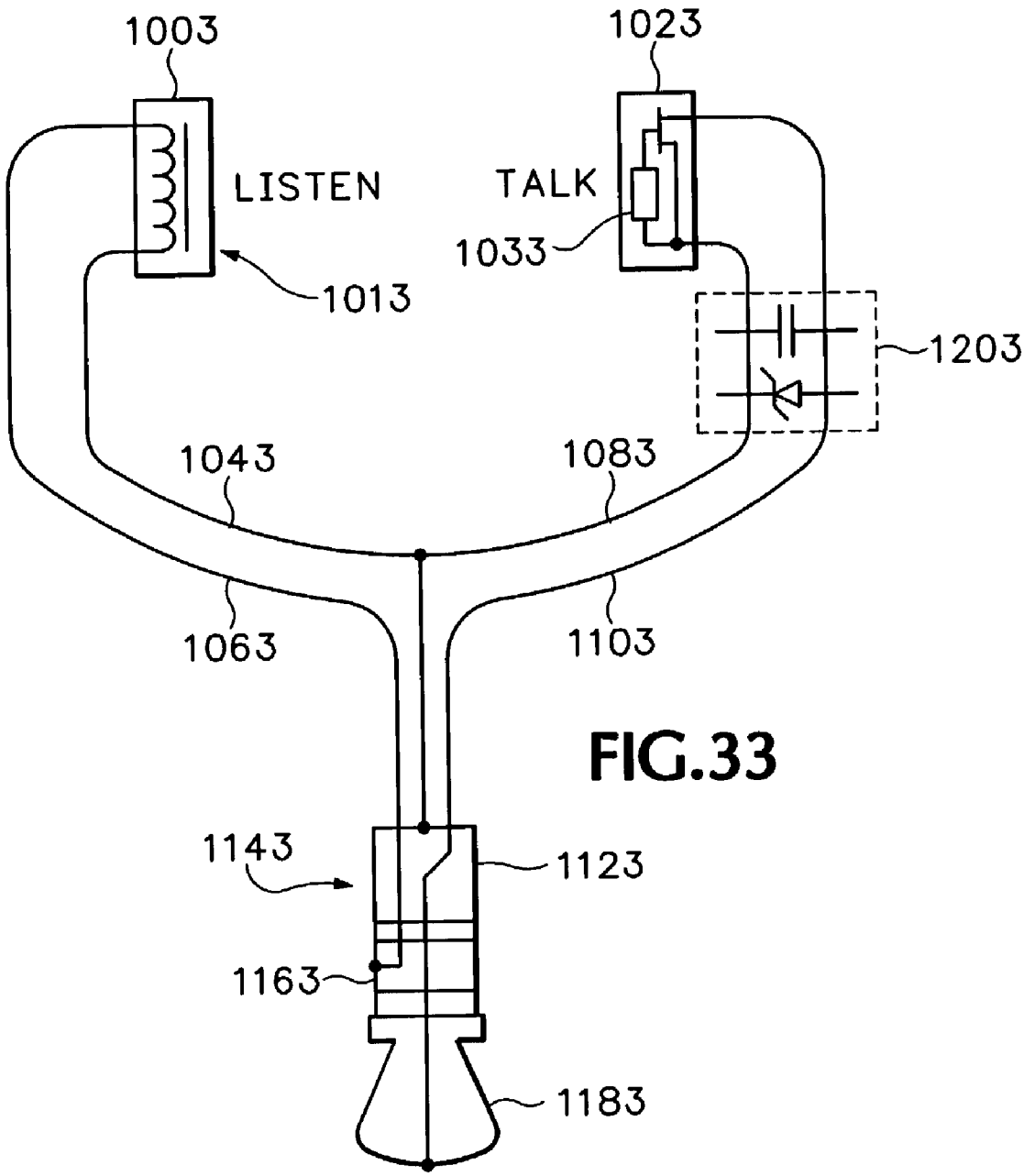
FIG. 33 is a schematic diagram of one full duplex circuit that can be used in either the loop down headset or the loopback headset.

FIG. 33 is a schematic diagram showing one embodiment of the full duplex circuitry that can be located in either the headset 1433 shown in FIG. 26 or the headset 5033 shown in FIG. 30. The circuitry includes a speaker circuit 1003 and a microphone circuit 1023. Each circuit has two electrical terminals, with one serving as the common or "ground" node. A pair of wires 1043, 1063 and 1083, 1103 are connected to these terminals, and are ultimately joined in a single cord terminating in a connector plug 1143. The wires connected to the ground node 1043, 1083 are joined together and terminate at the sleeve connection 1123 of plug 1143. The wire connected to the opposite terminal of the speaker circuit 1003 is connected to a ring portion 1163 of the plug 1143. On the other side of the headset, the wire 1103 from the microphone circuit 1023 is connected to the tip portion 1183 of the plug 1143.

The speaker circuit 1003 contains a transducer 1013 that converts an electrical signal into an audio output. The microphone circuit 1023 contains a transducer 1033 that converts an audio input into an electrical signal which is communicated to a telephony device via the wires 1083, 1103. Any of the other circuits described above can also be used instead of the circuitry shown in FIG. 33.

A filter circuit 1203 includes a capacitor and an zenor diode that are coupled in parallel across the wires 1083 and 1103. The capacitor in one implementation is approximately 33 Pico farads. The filter circuit 1203 filters out selected low frequency noise from the electrical transmit signal output by the microphone circuit 1023.

The circuitry described above can use dedicated processor systems, micro controllers, programmable logic devices, or microprocessors that perform some or all of the mail notification operations. Some of the operations described above may be implemented in software and other operations may be implemented in hardware.

For the sake of convenience, the operations are described as various interconnected functional blocks or distinct software modules. This is not necessary, however, and there may be cases where these functional blocks or modules are equivalently aggregated into a single logic device, program or operation with unclear boundaries. In any event, the functional blocks and software modules or described features can be implemented by themselves, or in combination with other operations in either hardware or software.

Having described and illustrated the principles of the invention in a preferred embodiment thereof, it should be apparent that the invention may be modified in arrangement and detail without departing from such principles. Claim is made to all modifications and variation coming within the spirit and scope of the following claims.

The invention claimed is:

1. An audio device, comprising:

an earpiece having a transducer that converts an input audio signal from a user into a transmit signal and also converts a receive sianal received from an external device into an audio output sianal intended for listening to by the user, the receive signal including transmit signal components;

a full duplex mode circuit coupled to the transducer including:

a first amplifier having a first input coupled to a first terminal of the transducer and a second input receiving a receive signal with reduced transmit signal components, wherein the first amplifier outputs a combined output signal that includes the transmit signal and the receive signal with the reduced transmit sianal components; and a second amplifier having a first input coupled to ground and a second input coupled to the same receive signal with the reduced transmit signal components received by the first amplifier, wherein the second amplifier outputs the receive signal with the reduced transmit signal components; and a digitall signal processing system that isolates the transmit signal from the receive signal, including;

a first input receiving the combined output signal from the first amplifier;

a second input receiving the receive signal from the external device having the transmit signal comnonents;

an output outputting the receive signal with the reduced transmit signal components to the first and second amplifiers: and a third input receiving the receive signal with the reduced transmit signal components back from the second amplifier.

2. The audio device of claim 1, wherein the digital signal processing system comprises:

a first analog to digital (A/D) converter converting the combined output signal received at the first input into a digital combined output signal;

a second A/D converter converting the receive signal from the external device received at the second input into a digital receive signal with transmit signal components; and a third A/D converter converting the receive signal with the reduced transmit signal components at the third input into a digital receive signal with reduced transmit signal components.

3. The audio device of claim 2, wherein the digital signal processing system further comprises:

a receive adaptive phase canceller shifting the phase of the digital receive signal with the reduced transmit signal components; and a first adder summing the phase shifted digital receive signal with the reduced transmit signal components and the digital combined output signal to cancel the digital receive signal with the reduced transmit signal comnonents from the digital combined output signal and outputting a digital transmit signal.

4. The audio device of claim 3, wherein the digital signal processing system further comprises:

a transmit adaptive phase canceller shifting the phase of the digital transmit signal outputted from the first adder; and a second adder summing the phase shifted digital transmit signal and the digital receive signal from the external device with transmit signal components to cancel the transmit signal components from the digital receive signal from the external device and outputting a receive signal with reduced transmit signal components.

5. The audio device of claim 4, wherein the digital signal processing system further comprises:

a first digital to analog converter converting the digital transmit sianal into an analog transmit signa; and a second D/A converter converting the receive signal having reduced transmit sianal comnonents into an analog receive signal.

6. A method for providing full-duplex communications in an earpiece, comprising:

convening an audio input into an analog transmit signal in an interface circuit in the earpiece;

receiving an analog receive signal intended for a user from an external device, the receive signal having transmit signal components, in a digital signal processing system;

outputting a receive signal having reduced transmit signal components from the digital signal processing system to the interface circuit in the earpiece;

converting the receive signal having reduced transmit signal comnonents into an audio output in the interface circuit in the earpiece;

feeding the same receive signal having reduced transmit signal components outputted to the interface circuit back to the digital signal processing system;

generating a combined output signal that includes the transmit signal and the receive signal having reduced transmit signal components; and cancelling the receive signal having reduced transmit signal components from the combined output sianal in the digital signal processing system.

7. The method according to claim 6 including using a same transducer in the interface circuit to convert the audio inputs into the analog transmit signal and convert the analog receive signals into the audio output.

8. The method according to claim 6, wherein cancelling the receive signal having reduced transmit signal components from the combined output signal comprises:

phase compensating a digital receive signal having reduced transmit signal components;

applying the phase compensated receive signal having reduced transmit signal components to a combined digital output signal to cancel the receive signal having reduced transmit signal components from the combined digital output signal; and outputting a digital transmit signal.

9. The method according to claim 8, wherein outputting the receive signal having reduced transmit signal components from the digital signal processing system comprises:

phase compensating the digital transmit signal; and applying the phase compensated transmit signal to the receive signal received from the external device having transmit signal components to cancel the transmit signal components from the receive signal received from the external device.

10. An audio device, comprising:

first and second earpieces, each having a transducer for converting an audio input into an electrical transmit signal and converting an analog receive signal received from an external device and intended for outputting to a user into an audio output, wherein the first transducer operates as a speaker and the second transducer operates either in a microphone mode or in a speaker mode;

a switching circuit adapted to select the operational mode of the second transducer; and a full-duplex transmit and receive circuit, comprising:

a first amplifier having a first input coupled to the positive terminal of the transducer in the first earpiece and an output coupled to a transmit signal output;

a second amplifier having a first input coupled to the negative terminal of the transducer in the second earpiece and an output coupled to the transmit signal output; and a third amplifier coupled between the outputs of the first and second amplifiers and the transmit signal output.

11. An audio device according to claim 10 wherein the full-duplex transmit and receive circuit outputs a first receive and transmit signal out of phase with a second receive and transmit signal.

12. An audio device according to claim 11 wherein the full-duplex transmit and receive circuit combines the first and second receive and transmit signal.

13. An audio device according to claim 12 wherein the full-duplex transmit and receive circuit cancels the receive signal in the combined first and second receive and transmit signals and increases the transmit signal in the combined first and second receive and transmit signals.

14. An audio device according to claim 10 wherein the full-duplex transmit and receive circuit includes a level control circuit maintaining a receive signal at a constant level.

15. An audio device according to claim 14 wherein the level control circuit includes:

an op-amp including an input that monitors a voltage level of the receive signal;

a transistor circuit activated by the op-amp when the receive voltage rises above a preselected value, the transistor circuit when activated pulling down the voltage level to the preselected value.

16. An audio device according to claim 14 wherein the level control circuit includes a manually adjustable resistor circuit.

17. An audio device according to claim 10 including a switching circuit for switching the full-duplex transmit and receive circuit and the transducers into operating as a one-way speaker device.

* * * * *